US009310150B1

(12) United States Patent
Geissele

(10) Patent No.: US 9,310,150 B1
(45) Date of Patent: Apr. 12, 2016

(54) TRIGGER MECHANISM WITH SELECTABLE PULL CHARACTERISTICS

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 14/696,263

(22) Filed: Apr. 24, 2015

(51) Int. Cl.

| | |
|---|---|
| ***F41A 19/16*** | (2006.01) |
| ***F41A 19/14*** | (2006.01) |
| ***F41A 19/12*** | (2006.01) |
| ***F41A 19/10*** | (2006.01) |

(52) U.S. Cl.
CPC ..... *F41A 19/16* (2013.01); *F41A 19/10* (2013.01); *F41A 19/12* (2013.01); *F41A 19/14* (2013.01)

(58) Field of Classification Search
USPC ..... 42/69.03
See application file for complete search history.

(56) References Cited

U.S. PATENT DOCUMENTS 3,045,555 A * 7/1962 Stoner ..... F41A 19/46 89/142
3,292,492 A * 12/1966 Sturtevant ..... F41A 19/02 89/128
5,251,533 A * 10/1993 Layton ..... F41A 19/33 89/129.02
5,760,328 A * 6/1998 Robbins ..... F41A 19/46 89/129.02
7,421,937 B1 * 9/2008 Gangl ..... F41A 17/46 42/69.03
8,667,881 B1 * 3/2014 Hawbaker ..... F41A 19/46 42/69.01
2009/0188145 A1 * 7/2009 Fluhr et al. ..... F41A 19/16 42/69.01

OTHER PUBLICATIONS

"M16 4-Way Selector Install", Feb. 25, 2012, ar15.com, pp. 1-3.*

* cited by examiner

*Primary Examiner* — Troy Chambers
*Assistant Examiner* — Joshua Semick
(74) *Attorney, Agent, or Firm* — Merchant & Gould P.C.

(57) ABSTRACT

A trigger mechanism is provided with selectable pull characteristics. The trigger mechanism can include a mode selector element configured to select one of a plurality of disconnector elements designed to provide different pull characteristics. The trigger mechanism can include a trigger element including a trigger sear, a plurality of disconnector elements, a hammer element, and a mode selector. Each disconnector element can provide different pull characteristics. The hammer element is operable between a cocked position and a released position and includes a hammer sear configured to engage the trigger sear when the hammer element is in the cocked position. The mode selector element is adjustable between a plurality of positions to select between the different pull characteristics.

23 Claims, 25 Drawing Sheets

TRIGGER MECHANISM WITH SELECTABLE PULL CHARACTERISTICS

BACKGROUND

The firing of a firearm is typically controlled by a trigger mechanism. The trigger mechanism includes a trigger that, when pulled, releases spring-loaded components that initiate the firing sequence.

The characteristics of the pull of a trigger mechanism (also known as the "dynamics" of the trigger) greatly impact the accuracy of the firearm in different situations. The characteristics of the trigger pull are sometimes described by the takeup, the break, and the overtravel. The takeup is the amount of movement of the trigger until it comes to a point slightly before the trigger releases. The break involves the movement of the trigger from the point slightly before the release to the point of release. The overtravel is the distance that the trigger moves after the sear releases.

Trigger mechanisms are sometimes classified by a number of stages, such as including single stage triggers and two-stage triggers. A single stage trigger has no discernible movement (takeup) before the break, while a two-stage trigger has a noticeable takeup (the first stage), followed by a distinct increase in the force required to pull the trigger (the second stage) before the break. Each of these types of trigger mechanism has its benefits. The single stage trigger is quick and simple, and can be particularly useful when firing multiple shots in rapid succession. The two-stage trigger can be highly accurate by minimizing movement at the moment of the break.

Although the trigger mechanism can be replaced in some firearms, most firearms include only a single trigger mechanism, and therefore the trigger mechanism having the desired pull characteristics must be selected and installed into the firearm before the firearm can be used.

SUMMARY

In general terms, this disclosure is directed to a trigger mechanism with selectable pull characteristics. In one possible configuration and by non-limiting example, the trigger mechanism includes a mode selector element configured to select one of a plurality of disconnector elements designed to provide different pull characteristics. Various aspects are described in this disclosure, which include, but are not limited to, the following aspects.

One aspect is a trigger mechanism for a firearm comprising: a hammer element operable between a cocked position and a released position, the hammer element including a hammer sear; a trigger element including a trigger sear, the trigger element being moveable between a starting position and a pulled position, wherein when the trigger element is in the starting position the trigger sear is engaged with the hammer sear and holds the hammer element in the cocked position, and wherein when the trigger element is in the pulled position the hammer sear is released from the trigger sear; a plurality of disconnector elements, each configured to interact with the trigger element to provide different pull characteristics; and a mode selector element adjustable between a plurality of positions to select between the plurality of disconnector elements and the different pull characteristics.

Another aspect is a firearm for providing a plurality of trigger modes, the firearm comprising: a receiver body; and a trigger mechanism received and supported in the receiver body, the trigger mechanism comprising: a trigger element pivotally supported by the receiver body, the trigger element including a trigger sear; a plurality of disconnector elements pivotally supported by the receiver body and configured to provide different pull characteristics; a hammer element pivotally supported by the receiver body and operable between a cocked position and a released position, the hammer element including a hammer sear, the hammer sear configured to engage the trigger sear when the hammer element is in the cocked position; and a mode selector element adjustable between a plurality of positions to select between different trigger modes providing the different pull characteristics.

Yet another aspect is a trigger mechanism for a firearm comprising: a trigger element including a trigger sear; a first disconnector element configured to provide a two-stage trigger mode; a second disconnector element configured to provide a single-stage trigger mode; a hammer element operable between a cocked position and a released position, the hammer element including a hammer sear configured to engage the trigger sear when the hammer element is in the cocked position; and a mode selector element adjustable between a first position, a second position, and a third position such that the mode selector element is configured to disable a movement of the first and second disconnector in the first position, to permit a movement of the first disconnector and disable a movement of the second disconnector in the second position, and to permit a movement of the second disconnector and disable a movement of the first disconnector in the third position.

Yet another aspect is a trigger mechanism for a firearm comprising: a trigger element including a trigger sear; a plurality of disconnector elements, each configured to provide different pull characteristics; a hammer element operable between a cocked position and a released position, the hammer element including a hammer sear configured to engage the trigger sear when the hammer element is in the cocked position; and a mode selector element adjustable between a plurality of positions to select between the different pull characteristics.

DETAILED DESCRIPTION

Figure 1:
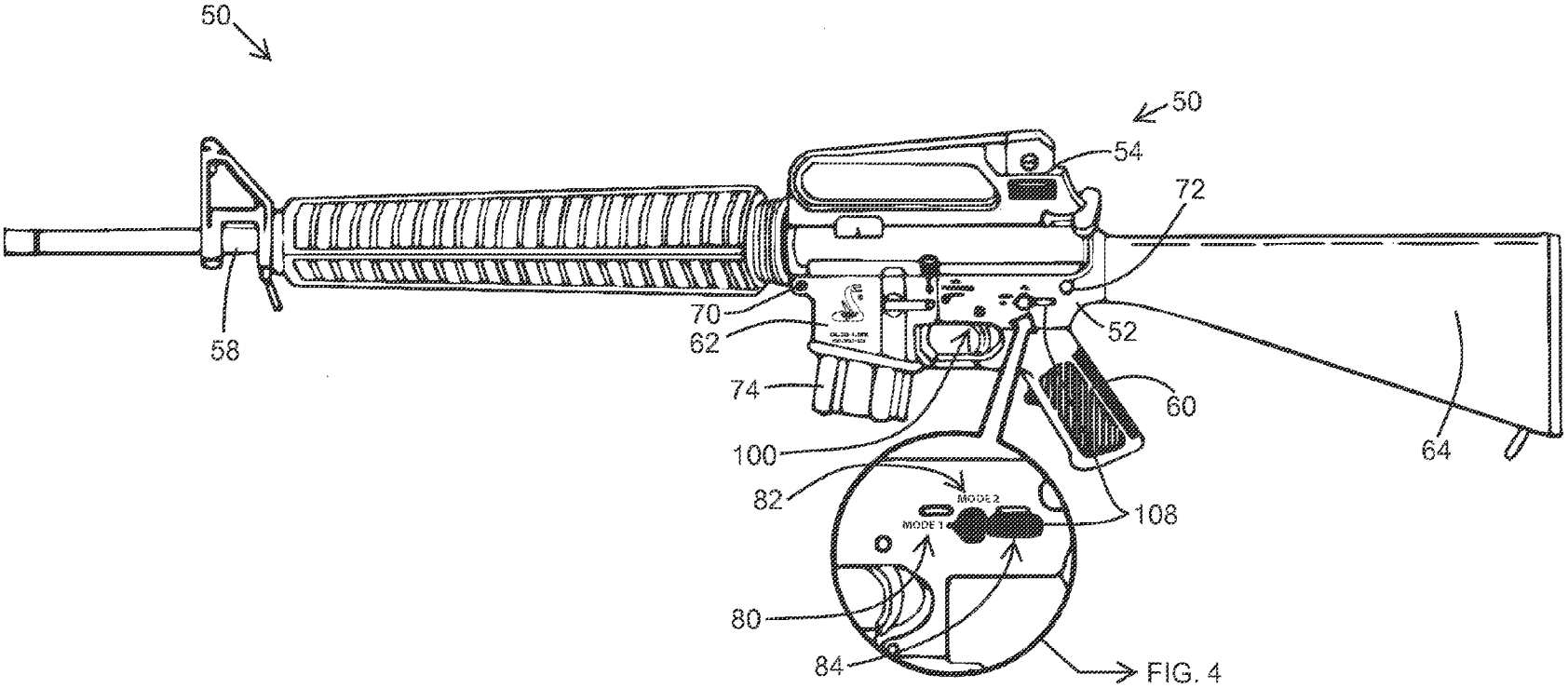
FIG. 1 is a side view of an example firearm.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

As used herein, the word "front" or "forward" corresponds to the direction opposite to an end of the trigger mechanism where the mode selector element is located (i.e., the left as shown in FIGS. 2, 3, and 10-21), and the word "rear," "rearward," or "back" corresponds to the end of the trigger mechanism where the mode selector element is located (i.e., the right as shown in FIGS. 2, 3, and 10-21).

FIG. 1 is a side view of an example firearm 50. The firearm 50 generally includes a receiver body 52 including an upper receiver 54 and a lower receiver 56, a barrel assembly 58, a pistol grip 60, a magazine well 62, a buttstock 64, and a trigger mechanism 100 including a mode selector element 108. Also shown are a pivot pin 70, a takedown pin 72, a magazine 74, and one or more mode selection marks 80, 82 and 84.

The firearm 50 can be of various types. Examples of the firearm 50 include, but are not limited to, handguns, rifles, shotguns, carbines, machine guns, submachine guns, personal defense weapons, automatic rifles, and assault rifles. In at least one embodiment, the firearm 50 is an AR-15, M-16 or M-4 type rifle, or one of their variants.

The receiver body 52 is configured to house a firing mechanism and associated components as found in, for example, AR-15, M-16 or M-4 type rifles and their variants. Such a firing mechanism typically includes the trigger mechanism 100 (FIG. 2), in which a spring-biased hammer that is cocked and then released by a sear upon actuating the triggering mechanism. The hammer strikes a firing pin carried by a bolt, which in turn is thrust forward to contact and discharge a cartridge loaded in a chamber. A portion of the expanding combustion gases traveling down the barrel is discharged off and used to drive the bolt rearward against a forward biasing force of a recoil spring for automatically ejecting the spent cartridge casing and automatically loading a new cartridge into the chamber from a magazine when the bolt returns forward. In at least one embodiment, the receiver body 52 includes an upper receiver 54 and a lower receiver 56.

The upper receiver 54 defines an internal longitudinally-extending cavity configured to receive a bolt assembly. The bolt assembly is slidably disposed in the cavity for axially reciprocating recoil movement therein. In at least one embodiment, the upper receiver 56 is an AR-15, M-16 or M-4 type upper receiver, or one of their variants.

The lower receiver 56 includes the pistol grip 60, the magazine well 62, and the buttstock 64. The lower receiver 56 defines a cavity therein to receive the trigger mechanism 100. In at least one embodiment, the lower receiver 56 is removably coupled to the upper receiver 54 using the pivot pin 70 and the takedown pin 72.

The barrel assembly 58 is configured to be installed to the receiver body 52 (for example, the upper receiver 54) and operates to provide a path to release an explosion gas and propel a projectile therethrough.

Figure 3:
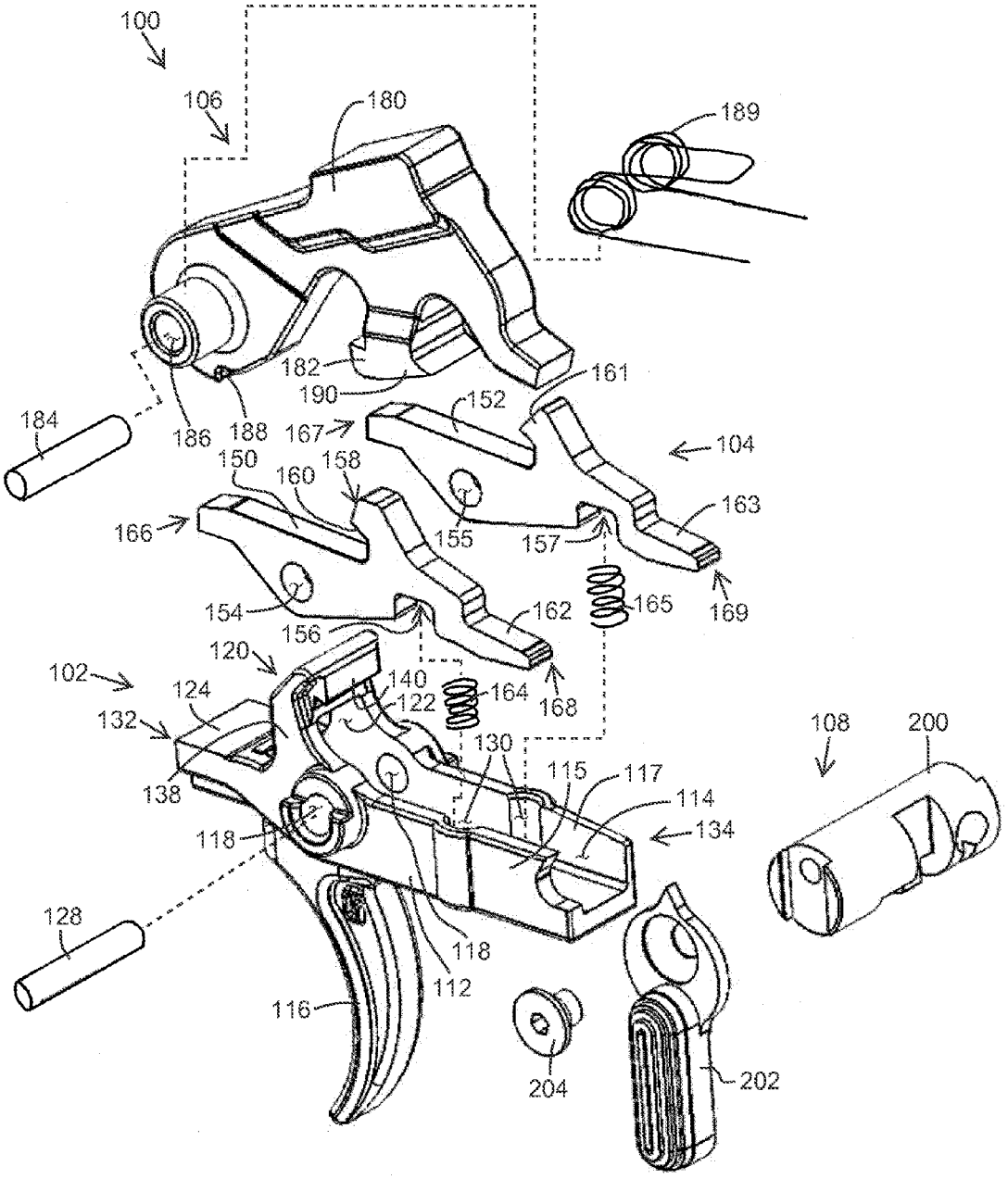
FIG. 3 is an exploded view of the trigger mechanism of FIG. 2.

The pistol grip 60 provides a mechanism held by the shooter's hand to orient the hand in a forward, vertical orientation to operate a trigger lever 116 (FIG. 3).

The magazine well 62 is configured to detachably receive a self-feeding magazine 74 for holding a plurality of cartridges. The magazine 74 is an ammunition storage and feeding device within the firearm 50.

The buttstock 64 provides a means for a shooter to firmly support the firearm 50 and easily aim it by holding the buttstock 64 against his or her shoulder when firing.

Figure 4:
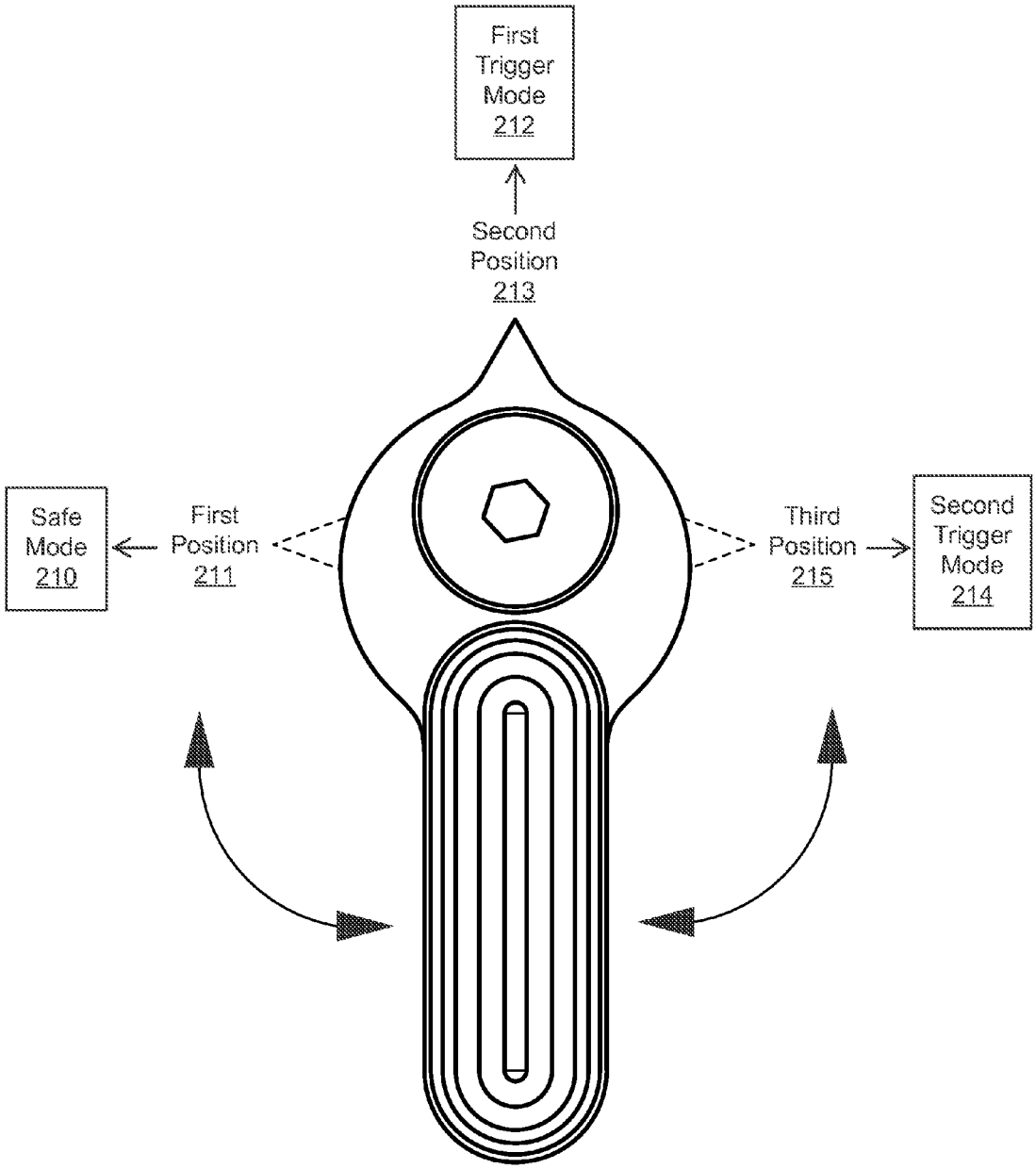
FIG. 4 is a schematic diagram illustrating example trigger modes of the trigger mechanism and corresponding example positions of a mode selector element.

The trigger mechanism 100 operates to actuate the firing sequence of the firearm 50 by operating the bolt assembly accommodated in the upper receiver 54. In at least some embodiments, the trigger mechanism 100 is configured to provide a plurality of triggering modes having different pull characteristics (including modes 210, 212 and 214 as illustrated in FIG. 4) and enable a shooter to select one of the triggering modes. An example of the trigger mechanism 100 is illustrated and described with reference to FIGS. 2-21.

The mode selector element 108 is pivotally supported in the lower receiver 56 and configured to switch the trigger mechanism 100 among the plurality of different trigger modes. As described below, the mode selection marks 80, 82 and 84 are provided on the lower receiver 56 to represent a trigger mode selected and implemented by the mode selector element 108. An example of the mode selector element 108 is illustrated and described along with the trigger mechanism 100 with reference to FIGS. 2-21.

Figure 2:
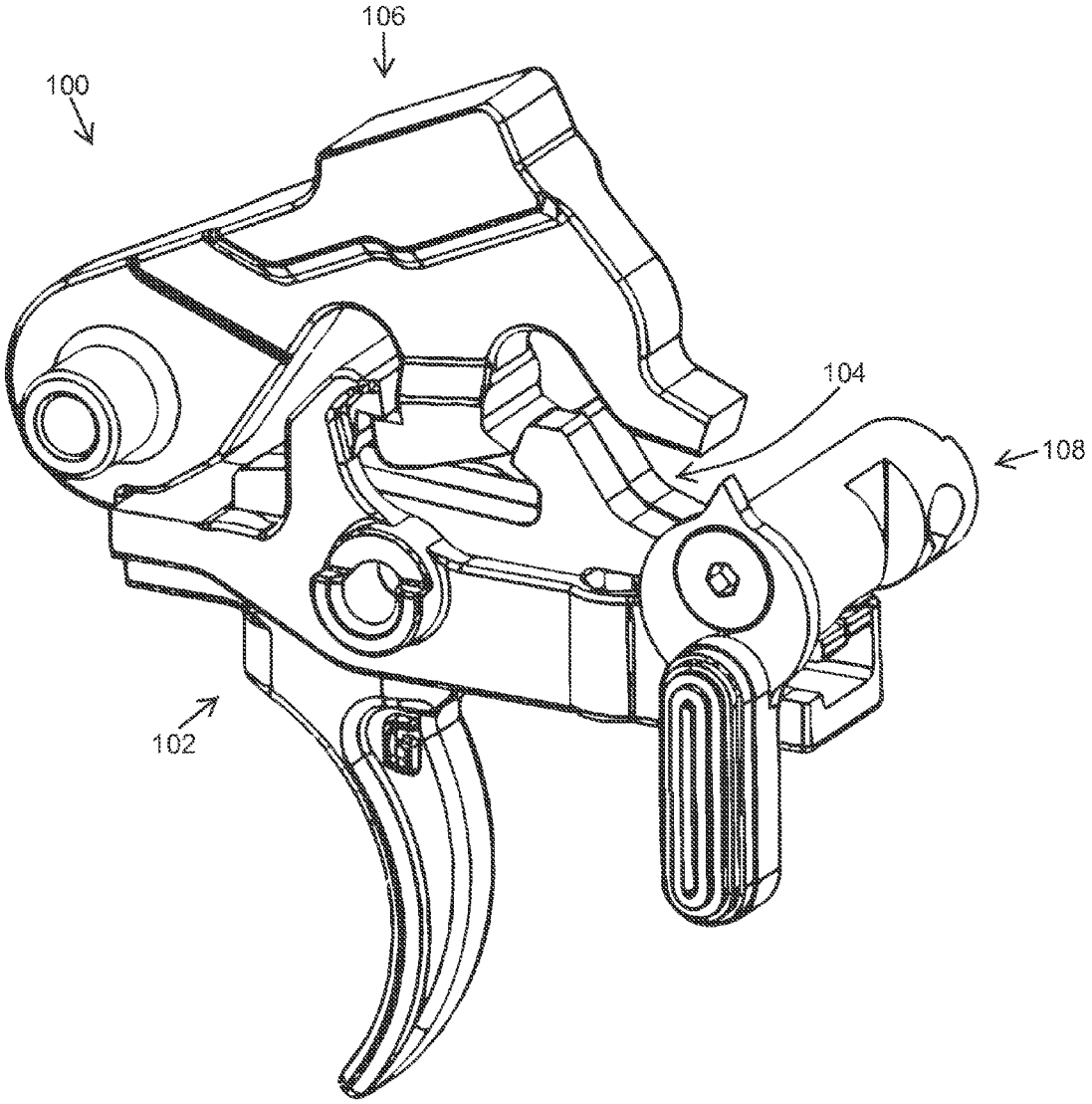
FIG. 2 is a perspective view of an example trigger mechanism.

FIG. 2 is a perspective view of an example trigger mechanism 100. In some embodiments, the trigger mechanism 100 includes a trigger element 102, a disconnector assembly 104, a hammer element 106, and a mode selector element 108.

The trigger mechanism 100 is carried by the lower receiver 56 in a manner known in the art using a trigger pin 128 and a hammer pin 184 (FIG. 3). In the illustrated example, a trigger element spring and a hammer element spring are omitted for clarity.

The trigger element 102 is pivotally connected to the lower receiver 56 of the firearm 50 and movable between a starting position and a pulled position. The trigger element 102 is configured to interact with the disconnector assembly 104 and the hammer element 106 to operate the hammer element 106 between a cocked position and a released position.

The disconnector assembly 104 is pivotally connected to the trigger element 102 and configured to interact with the trigger element 102 and the hammer element 106 to operate the hammer element 106 between the cocked position and the released position.

The hammer element 106 is configured to pivot between the cocked position and the released position such that the hammer element 106 strikes a firing pin of a bolt assembly as it moves from the cocked position to the released position.

The mode selector element 108 is pivotally supported in the lower receiver 56 of the firearm 50 and interacts with the disconnector assembly 104 to select one of multiple triggering modes. An example structure and operation of the mode selector element 108 is illustrated and described in more detail below.

FIG. 3 is an exploded view of the trigger mechanism 100 of FIG. 2. As described above, the trigger mechanism 100 includes the trigger element 102, the disconnector assembly 104, the hammer element 106, and the mode selector element 108.

In some embodiments, the trigger element 102 includes a trigger body 112 defining a trough 114, a trigger lever 116, a trigger pin receptacle 118, a trigger sear 120, and a trigger aperture 122. Also shown are a trigger cam surface 124, a trigger pin 128, and one or more spring placements 130.

The trigger body 112 extends between a forward trigger end 132 and a rearward trigger end 134 and is pivotally supported within the lower receiver 56 by the trigger pin 126 passing through the trigger pin receptacle 118. The trigger body 112 is biased by a trigger element spring (not shown) that is engaged between the trigger body 112 and the lower receiver 56. The trigger body 112 is biased in the rotational direction (i.e., clockwise) opposite to a rotational direction in which the trigger lever 116 is pulled to actuate the trigger mechanism 100 (i.e., counterclockwise).

The trough 114 is defined in the trigger body 112 and configured to receive the disconnector assembly 104. In at least one embodiment, the trough 114 is defined by opposing lateral walls (e.g., a first lateral wall 115 and a second lateral wall 117) at least partially extending along the trigger body 112. The disconnector assembly 104 (including first and second disconnectors 150 and 152) is pivotally supported within the trough 114 by the trigger pin 128. The trough 114 has one or more placements for one or more disconnector springs 164 and 165.

The trigger lever 116 extends from the trigger body 112 and is actuated by a shooter's finger. The trigger body 112 pivots against the biasing force generated by the trigger element spring as the trigger lever 116 is actuated in the rearward direction. In at least one embodiment, the trigger lever 116 is integrally formed with the trigger body 112.

The trigger pin receptacle 118 is formed in the trigger body 112 to receive the trigger pin 128 so that the trigger pin 128 passes therethrough. The trigger pin receptacle 118 is configured to receive the trigger pin 128 to pivotally connect the trigger element 102 relative to the lower receiver 56 of the firearm 50. In at least one embodiment, the trigger pin receptacle 118 includes a pair of holes that are formed on opposing sides of the trigger body 112 and aligned with pin holes 154 and 155 of the disconnector assembly 104. As such, the trigger pin 128 passes through one of the holes formed at one side (e.g., the first lateral wall 115) of the trigger body 112, the pin opening holes 154 and 155 of the disconnector assembly 104, and the other hole formed at the other side (e.g., the second lateral wall 117) of the trigger body 112.

The trigger sear 120 extends upwardly from the trigger body 112 and includes a leg or extension portion 138 and a hook portion 140. The leg portion 138 extends from opposing side surfaces of the trigger body 112, and the hook portion 140 is disposed on a distal end of the leg portion 138. It should be noted that while the trigger sear 120 is shown extending from a top of the trigger body 112, in alternative embodiments, the trigger sear 120 can extend from any suitable portion of the trigger body 112, such as from a front of the trigger body 112 or from a point adjacent the hook portion 140.

The trigger aperture 122 is defined by the trigger sear 120 and open to the trough 114. The trigger aperture 122 allows the disconnector assembly 104 to pass through and under the trigger sear 120 so that the disconnector assembly 104 pivotally operates under the trigger sear 120.

The trigger cam surface 124 is arranged at the forward trigger end 132 of the trigger body 112 and configured to engage the hammer element 106 for allowing the disconnector assembly 104 to interface with a hammer cam surface 188 of the hammer element 106 for holding the hammer element 106 as necessary.

The trigger pin 128 is configured to pivotally support the trigger element 102 and the disconnector assembly 104.

The spring placements 130 are defined in the trough 114 of the trigger body 112 to support the disconnector springs 164 and 165.

With continued reference to FIG. 3, the disconnector assembly 104 includes a plurality of disconnectors. In at least one embodiment, the disconnector assembly 104 includes a first disconnector 150 and a second disconnector 152. The first and second disconnectors 150 and 152 are configured to provide different trigger modes having different pull characteristics.

The trigger mechanism can be designed to provide a variety of different and selectable pull characteristics. In some embodiments the pull characteristics can be described by at least one of a takeup, a break, and an overtravel. The takeup is the amount of movement of the trigger element 102 (e.g., the trigger lever 116) before the trigger sear 120 and the hammer sear 182 are disengaged. The break involves the movement of the trigger sear 120 to the point of release from the hammer sear 182. The overtravel is a distance that the trigger element 102 moves after the trigger sear 120 releases from the hammer sear 182. In other embodiments, the pull characteristics are defined by other aspects or features.

In at least one embodiment, the first disconnector 150 is configured to provide a two-stage trigger mode, and the second disconnector 152 is configured to provide a single-stage trigger mode. Accordingly, the first disconnector 150 is also referred to herein as a two-stage disconnector, and the second disconnector 152 is also referred to herein as a single-stage disconnector. As described with reference to FIGS. 13 and 18, a single stage trigger mode has little or no discernible movement (takeup) before the break, while a two-stage trigger mode has a noticeable takeup (the first stage), followed by a distinct increase in the force required to pull the trigger (the second stage) before the break.

Although it is primarily described herein that the disconnector assembly 104 includes two disconnectors 150 and 152 (also referred to herein as disconnector elements), which include a two-stage trigger disconnetor and a single-stage trigger disconnector, to provide two different pull characteristics, other combinations of two or more disconnectors are possible to allow selecting between a plurality of pull characteristics. In some embodiments, the disconnector assembly 104 includes more than two different disconnectors designed to provide different pull characteristics. In other embodiments, the disconnector assembly 104 includes two or more two-stage disconnectors providing different pull characteristics (e.g., pull weight and/or length) or two or more single-stage disconnector to provide different pull characteristics (e.g., pull weight and/or length). Other embodiments are also possible. As the disconnector assembly 104 varies, the mode selector element 108 is accordingly modified to interact with the different disconnectors in a similar manner in accordance with the principles of the present disclosure. Example combinations of selectable pull characteristics that can be implemented by the disconnector assembly 104 are illustrated and described in more detail with reference to FIGS. 22-25.

In at least one embodiment, the first and second disconnectors 150 and 152 are arranged side-by-side and pivot on the trigger pin 128 and bears on the surface of the trigger pin 128.

In at least one embodiment, the first disconnector 150 includes a first pin hole 154, a first spring seat 156, a first disconnector contact surface 158, a first disconnector catch 160, and a first disconnector leg 162. Also shown is a first disconnector spring 164.

The first disconnector 150 extends from a forward disconnector end 166 and a rearward disconnector end 168, and is received in the trough 114 of the trigger element 102 with the forward disconnector end 166 and the rearward disconnector end 168 adjacent the forward trigger end 132 and the rearward trigger end 134.

The first pin hole 154 is configured to receive the trigger pin 128 such that the first disconnector 150 is pivotally supported by the trigger pin 128.

The first spring seat 156 is configured to support one end of the first disconnector spring 164 while the other end supported by the spring placement 130 in the trough 114.

The first disconnector contact surface 158 is configured to selectively contact a hammer tongue 190 of the hammer element 106 during a first trigger pulling stage in a two-stage trigger mode.

The first disconnector catch 160 is configured to catch the hammer tongue 190 of the hammer element 106 as the hammer element 106 returns to the cocked position after firing.

The first disconnector leg 162 is arranged at the rearward disconnector end 168 and configured to selectively interact with the selector block 200 of the mode selector element 108.

Similarly to the first disconnector 150, the second disconnector 152 includes a second pin hole 155, a second spring seat 157, a second disconnector catch 161, and a second disconnector leg 163. Also shown is a second disconnector spring 165.

The second disconnector 152 extends from a forward disconnector end 167 and a rearward disconnector end 169, and is received in the trough 114 of the trigger element 102 with the forward disconnector end 167 and the rearward disconnector end 169 adjacent the forward trigger end 132 and the rearward trigger end 134. In at least one embodiment, the second disconnector 152 is arranged adjacent the first disconnector 150 such that the first and second disconnector 150 and 152 are pivotally disposed in the trough 114 of the trigger element 102.

The second pin hole 155 is configured to receive the trigger pin 128 such that the second disconnector 152 is pivotally supported by the trigger pin 128.

The second spring seat 157 is configured to support one end of the second disconnector spring 165 while the other end supported by the spring placement 130 in the trough 114.

The second disconnector catch 161 is configured to catch the hammer tongue 190 of the hammer element 106 as the hammer element 106 returns to the cocked position after firing.

The second disconnector leg 163 is arranged at the rearward disconnector end 169 and configured to selectively interact with the selector block 200 of the mode selector element 108.

With continued reference to FIG. 3, the hammer element 106 includes a hammer body 180, a hammer sear 182, a hammer pin 184, a hammer pin receptacle 186, a hammer cam surface 188, and a hammer tongue 190.

The hammer body 180 is pivotally supported by the hammer pin 184 within the lower receiver 56 of the firearm 50. In other embodiments, the hammer body 180 can be pivotally supported in other manners. The hammer body 180 is spring loaded by a hammer element spring 189.

The hammer sear 182 is configured to engage the trigger sear 120 in a cocked position. In the cocked position, the hammer sear 182 is fully engaged in the trigger sear 120. Pulling the trigger lever 116 cause the trigger element 102 and the disconnector assembly 104 (either the first disconnector 150 or the second disconnector 152) to rotate about the trigger pin 128 and pull the trigger sear 120 off the hammer sear 182. For example, when the trigger element 102 is in the starting position, the trigger sear 120 is engaged with the hammer sear 182 and holds the hammer element 106 in the cocked position. When the trigger element 102 is in the pulled position, the hammer sear 182 is released from the trigger sear 120.

The hammer pin 184 is used to pivotally support the hammer body 180 relative to the lower receiver 56 of the firearm 50. The hammer body 180 pivots on the hammer pin 184 and bears on the surface of the hammer pin 184.

The hammer pin receptacle 186 is formed through the hammer body 180 and configured to receive the hammer pin 184.

The hammer cam surface 188 is configured to interact with the trigger cam surface 124 to provide a secondary safety sear function. For example, where the trigger sear 120 disengages from the hammer sear 182 accidentally, the trigger cam surface 124 engages the hammer cam surface 188 to prevent the hammer element 106 from being activated by the hammer element spring 189. The trigger cam surface 124 and the hammer cam surface 188 come into contact with each other without the trigger lever 116 being pulled rearward.

The hammer tongue 190 is arranged to be opposite to the hammer sear 182 and configured to either engage the contact surface 158 and/or the first disconnector catch 160 of the first disconnector 150 or engage the second disconnector catch 161 of the second disconnector 152.

With continued reference to FIG. 3, the mode selector element 108 includes a selector block 200, a selector lever 202, and a selector coupler 204.

The mode selector element 108 is rotatably supported by the lower receiver 56 of the firearm 50. In at least one embodiment, the mode selector element 108 is arranged adjacent the rearward trigger end 134 of the trigger body 112. The mode selector element 108 is rotatable to select a plurality of different trigger modes, as illustrated in FIG. 4.

The selector block 200 is configured to selectively engage the disconnector assembly 104. The selector block 200 operates to switch between multiple trigger modes. In at least one embodiment, the selector block 200 allows one of the first and second disconnectors 150 and 152 to pivot around the trigger pin 128 while preventing the other from moving. The selector block 200 can also block both of the first and second disconnectors 150 and 152 from pivoting in a safe mode. An example of the selector block 200 is illustrated and described in more detail with reference to FIGS. 5-9.

The selector lever 202 is attached to the selector block 200 to rotate the selector block 200 between different trigger modes. As shown in FIG. 1, the selector lever 202 is exposed at the lower receiver 56 of the firearm 50 so that a user rotates the selector lever 202 to change the position of the selector block 200. As described below, for example, the selector lever 202 can be rotated in three different positions, such as a first position 211, a second position 213, and a third position 215 (FIG. 4). The first, second, and third positions can be spaced apart by 90 degrees. For example, the selector lever 202 is directed rearwards in the first position, downwards in the second position, and forwards in the third position.

The selector coupler 204 is used to couple the selector lever 202 to the selector block 200. In other embodiments, the selector lever 202 can be attached to the selector block 200 in other manners, such as welding and adhesive. In yet other embodiments, the selector lever 202 can be formed integrally with the selector block 20.

FIG. 4 is a schematic diagram illustrating example trigger modes of the trigger mechanism 100 and corresponding example positions of the mode selector element 108. As depicted, the trigger mechanism 100 can operate in three different trigger modes: a safe mode 210, a first trigger mode 212, and a second trigger mode 214. The first and second trigger modes 212 and 214 are configured to provide different pull characteristics. The three different modes 210, 212, and 214 are interchangeable by changing a position of the mode selector element 108 into one of three positions 211, 213, and 215.

At the safe mode 210, the trigger mechanism 100 is unable to operate and thus prevented from accidental discharge of the firearm 50. In at least one embodiment, the mode selector element 108 is in a first position 211 (e.g., a safe position) to implement the safe mode 210, thereby blocking the disconnector assembly 104 from pivoting around the trigger pin 128. In at least one embodiment, when the mode selector element 108 is in the first position 211, the selector lever 202 of the mode selector element 108 is arranged to extend rearwards (to the right from the view of FIG. 1).

At the first trigger mode 212, the trigger mechanism 100 allows the first disconnector 150, which is configured to provide a first pull characteristic, to operate as intended and disallows the operation of the second disconnector 152, which is configured to provide a second pull characteristic. The mode selector element 108 is in a second position 213 to implement the first trigger mode 212. In at least one embodiment, the first pull characteristic is a two-stage trigger pull characteristic. As described below, in the first trigger mode 212, the first disconnector 150 is enabled to pivot about the trigger pin 128 while the second disconnector 152 is blocked from pivoting about the trigger pin 128. In at least one embodiment, when the mode selector element 108 is in the second position 213, the selector lever 202 of the mode selector element 108 is arranged to extend downwards from the view of FIG. 1.

At the second trigger mode 214, the trigger mechanism 100 allows the second disconnector 152, which is configured to provide the second characteristic, to operate as intended and disallows the operation of the first disconnector 150, which is configured to provide the first pull characteristic. In at least one embodiment, the mode selector element 108 is in a third position 215 to implement the second trigger mode 214. In at least one embodiment, the second pull characteristic is a single-stage trigger pull characteristic. As described below, in the second trigger mode 214, the second disconnector 152 is enabled to pivot about the trigger pin 128 while the first disconnector 150 is blocked from pivoting about the trigger pin 128. In at least one embodiment, when the mode selector element 108 is in the third position 215, the selector lever 202 of the mode selector element 108 is arranged to extend forwards (to the left from the view of FIG. 1).

As illustrated, the first, second, and third positions 211, 213, and 215 can be spaced apart by 90 degrees. In other embodiments, the three positions 211, 213, and 215 can be apart in different increments.

Figure 5:
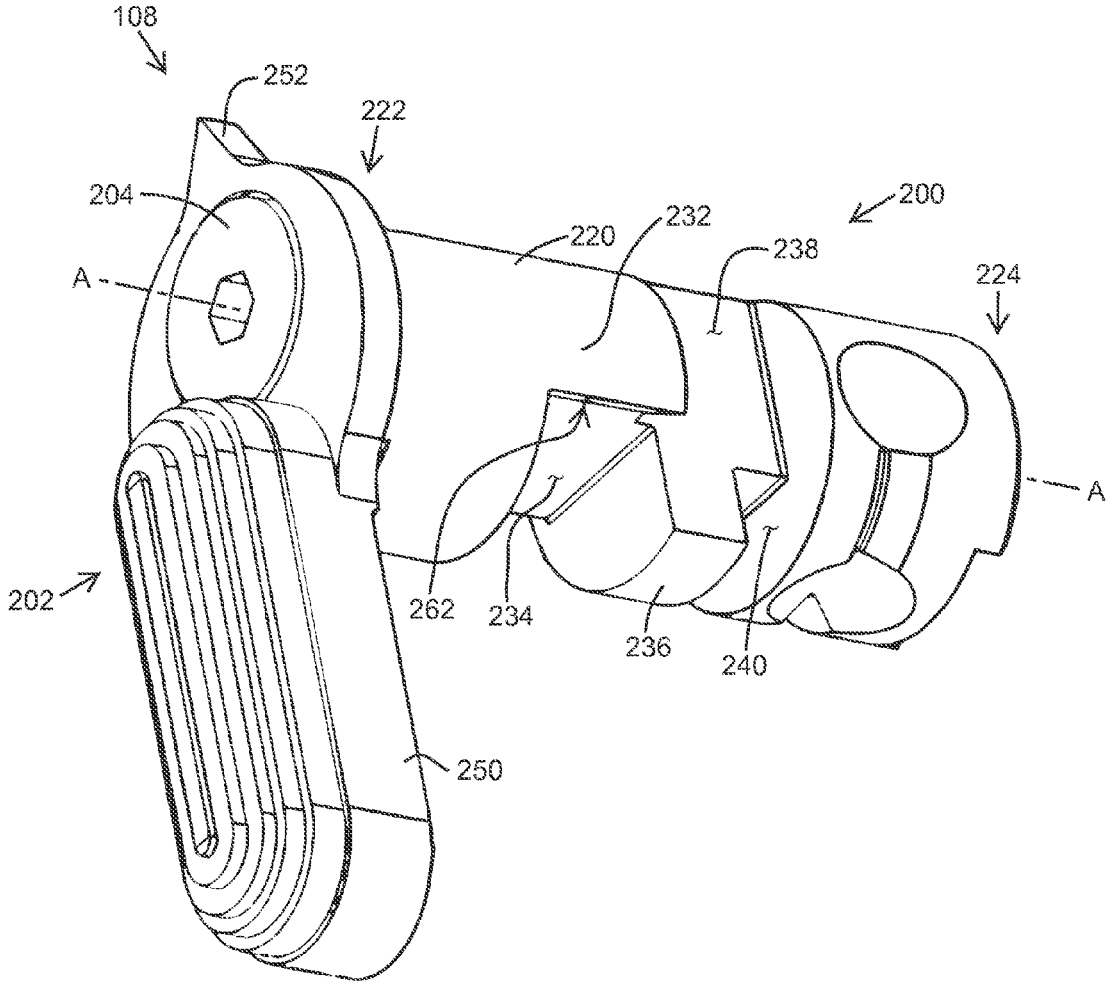
FIG. 5 is a perspective view of an example mode selector element.
Figure 6:
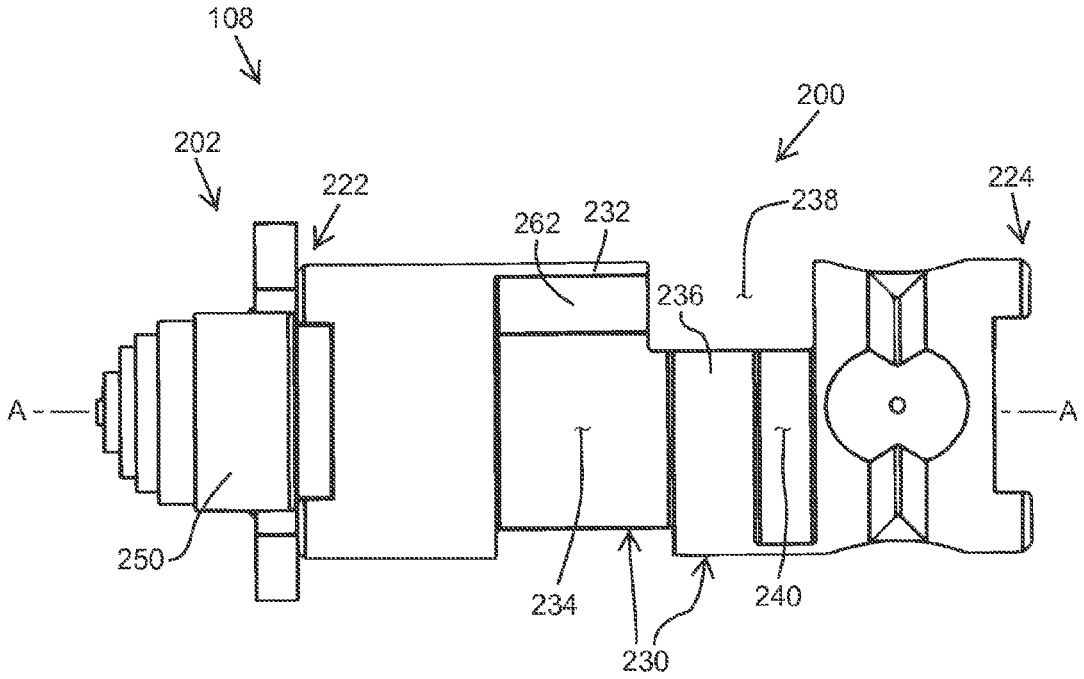
FIG. 6 is a bottom view of the mode selector element of FIG. 5.
Figure 7:
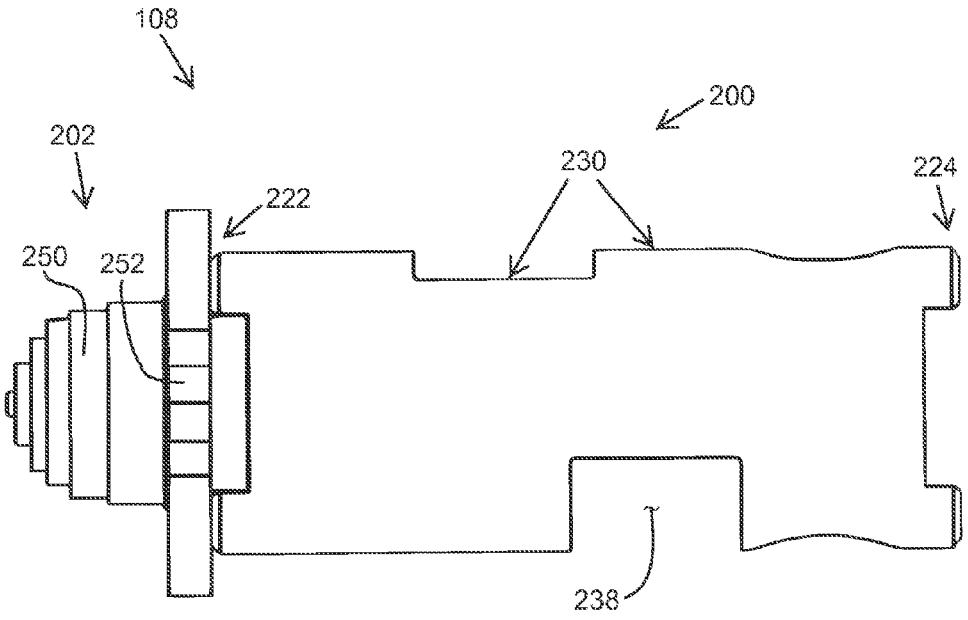
FIG. 7 is a top view of the mode selector element of FIG. 5.
Figure 8:
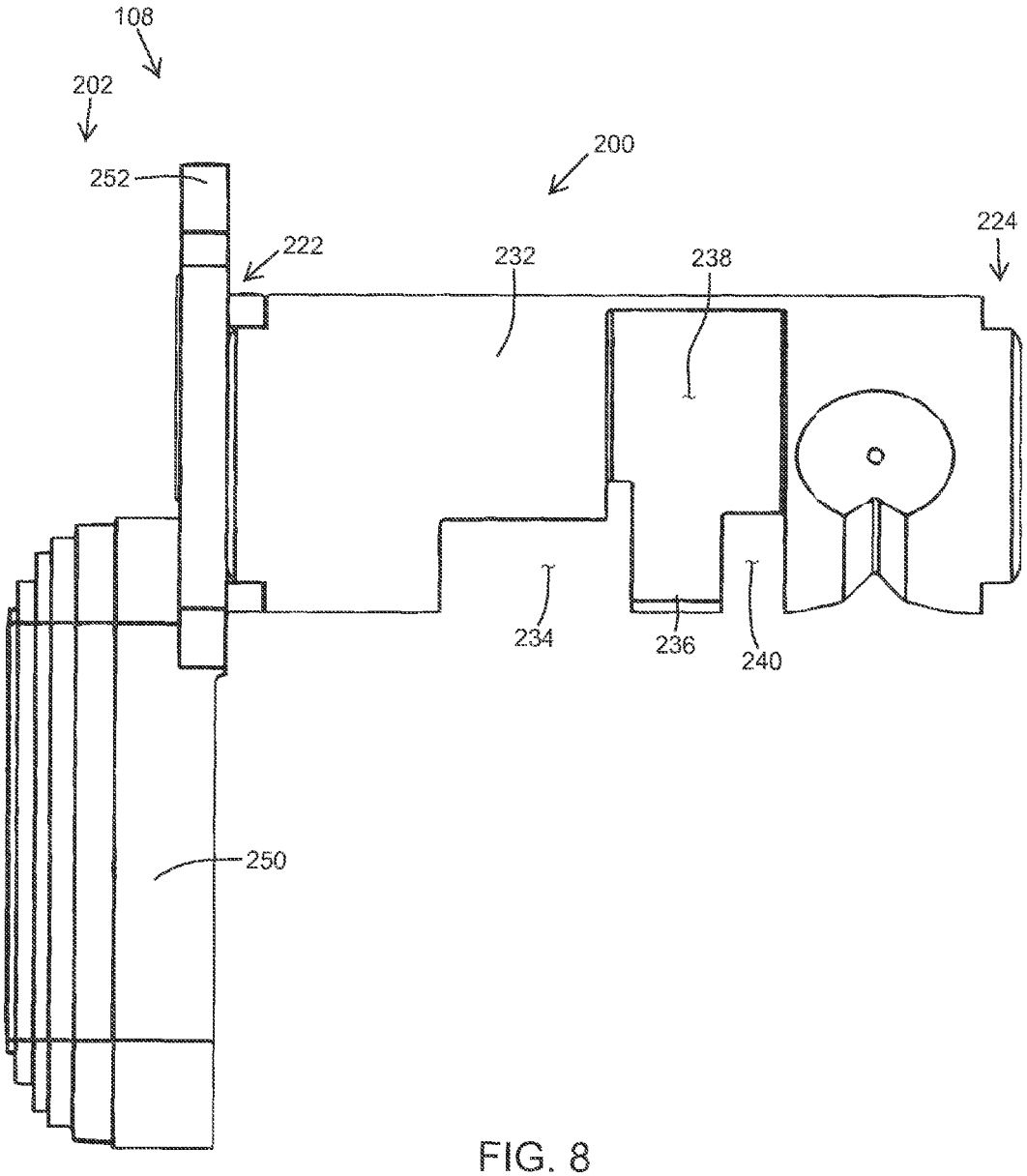
FIG. 8 is a front view of the mode selector element of FIG. 5.
Figure 9:
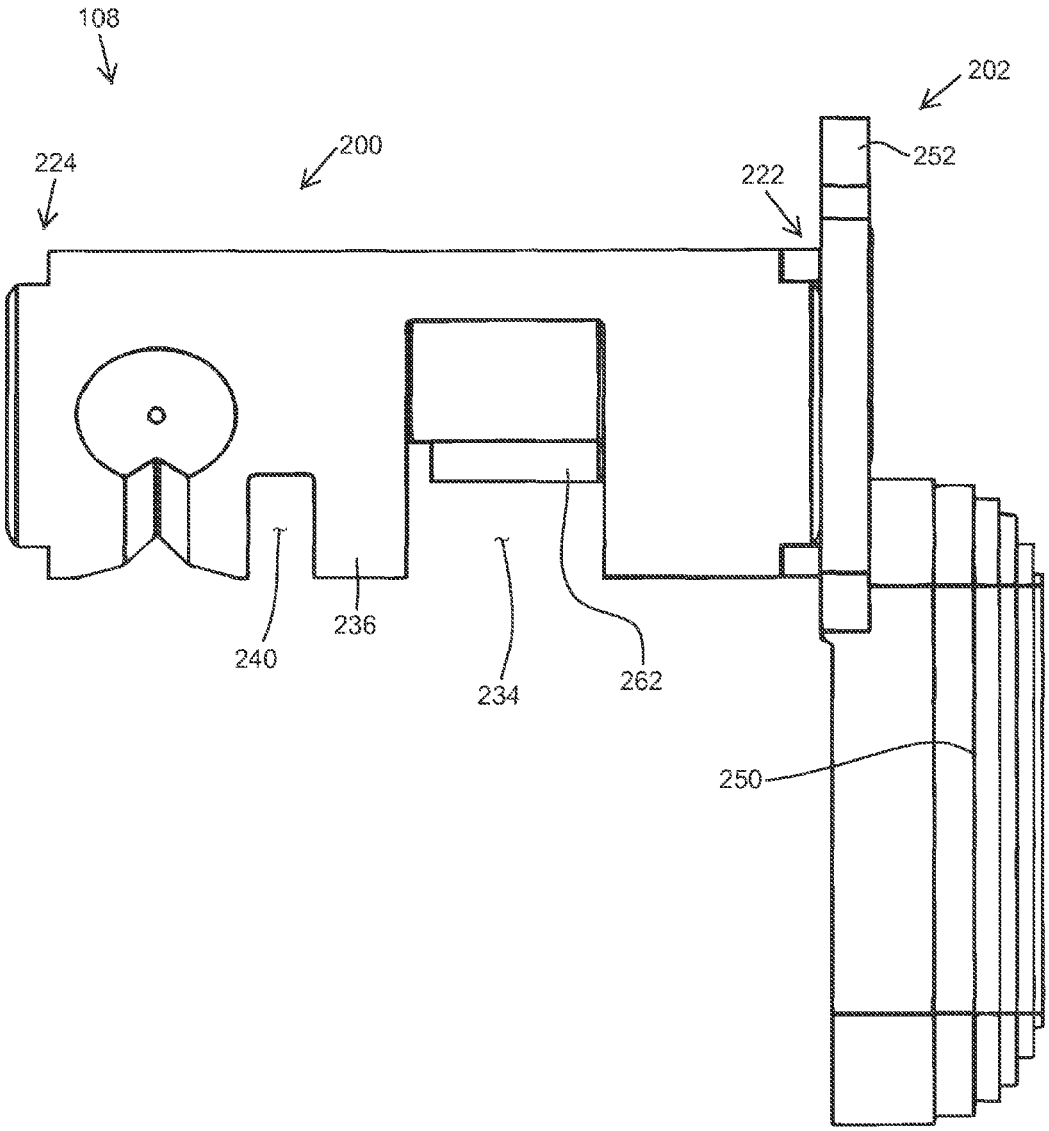
FIG. 9 is a rear view of the mode selector element of FIG. 5.

Referring to FIGS. 5-9, an example mode selector element 108 is described in more detail. In particular, FIG. 5 is a perspective view of an example mode selector element 108, FIG. 6 is a bottom view of the mode selector element 108 of FIG. 5, FIG. 7 is a top view of the mode selector element of FIG. 5, FIG. 8 is a front view of the mode selector element 108 of FIG. 5, and FIG. 9 is a rear view of the mode selector element of FIG. 5.

As illustrated, the mode selector element 108 includes the selector block 200, the selector lever 202, and the selector coupler 204.

The selector block 200 is configured to rotate about an axis of rotation A relative to the lower receiver 56 of the firearm 50. In at least one embodiment, the selector block 200 is generally a cylindrical body 220 extending between a first block end 222 and a second block end 224 along the axis of rotation A.

The selector block 200 rotates along the axis of rotation A to selectively interact with at least one of the first and second disconnector legs 162 and 163. When the mode selector element 108 is in the first position 211 (e.g., the safe mode 210), the selector block 200 engages the first and second disconnector legs 162 and 163 to prevent a movement of the first and second disconnectors 150 and 152. When the mode selector element 108 element is in the second position 213 (e.g., the first trigger mode 212), the selector block 200 engages the second disconnector leg 163 to prevent a movement of the second disconnector 152 and disengages the first disconnector leg 162 to enable a movement of the first disconnector 150. When the mode selector element 108 is in the third position 215 (e.g., the second trigger mode), the selector block 200 engages the first disconnector leg 162 to prevent a movement of the first disconnector 150 and disengages the second disconnector leg 163 to enable a movement of the second disconnector 152.

In at least one embodiment, the selector block 200 includes a common stopper portion 230, a first stopper portion 232, a first slot portion 234, a second stopper portion 236, a second slot portion 238, and a guide slot 240.

Figure 10:
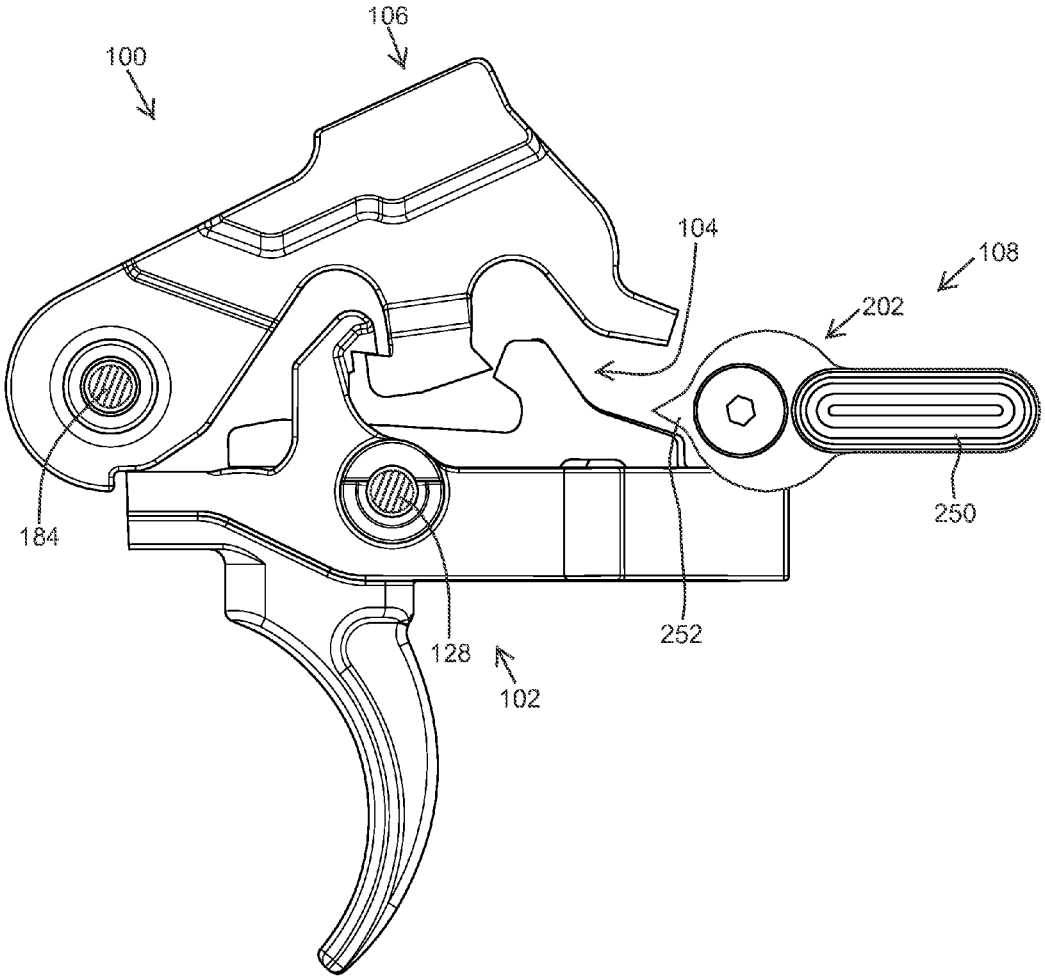
FIG. 10 schematically illustrates an example operation of the trigger mechanism in a safe mode.

The common stopper portion 230 is configured to engage the first and second disconnector legs 162 and 163 to disable the movement of the first and second disconnectors 150 and 152 when the mode selector element 108 is in the first position 211 (FIG. 10). The common stopper portion 230 can be aligned with both of the first and second disconnector legs 162 and 163 of the first and second disconnector 150 and 152. The common stopper portion 230 is shaped to limit the movement of the first and second disconnector legs 162 and 163 within a predetermined range that disables a triggering operation of the trigger mechanism 100. In at least one embodiment, as illustrated in FIG. 6, the common stopper portion 230 is substantially flush with an outer surface of the cylindrical body 220. In other embodiments, the common stopper portion 230 can have various shapes, such as grooves, insofar as the common stopper portion 230 engages the first and second disconnectors legs 162 and 163 to disable the pivoting movement of the first and second disconnectors 150 and 152.

Figure 16:
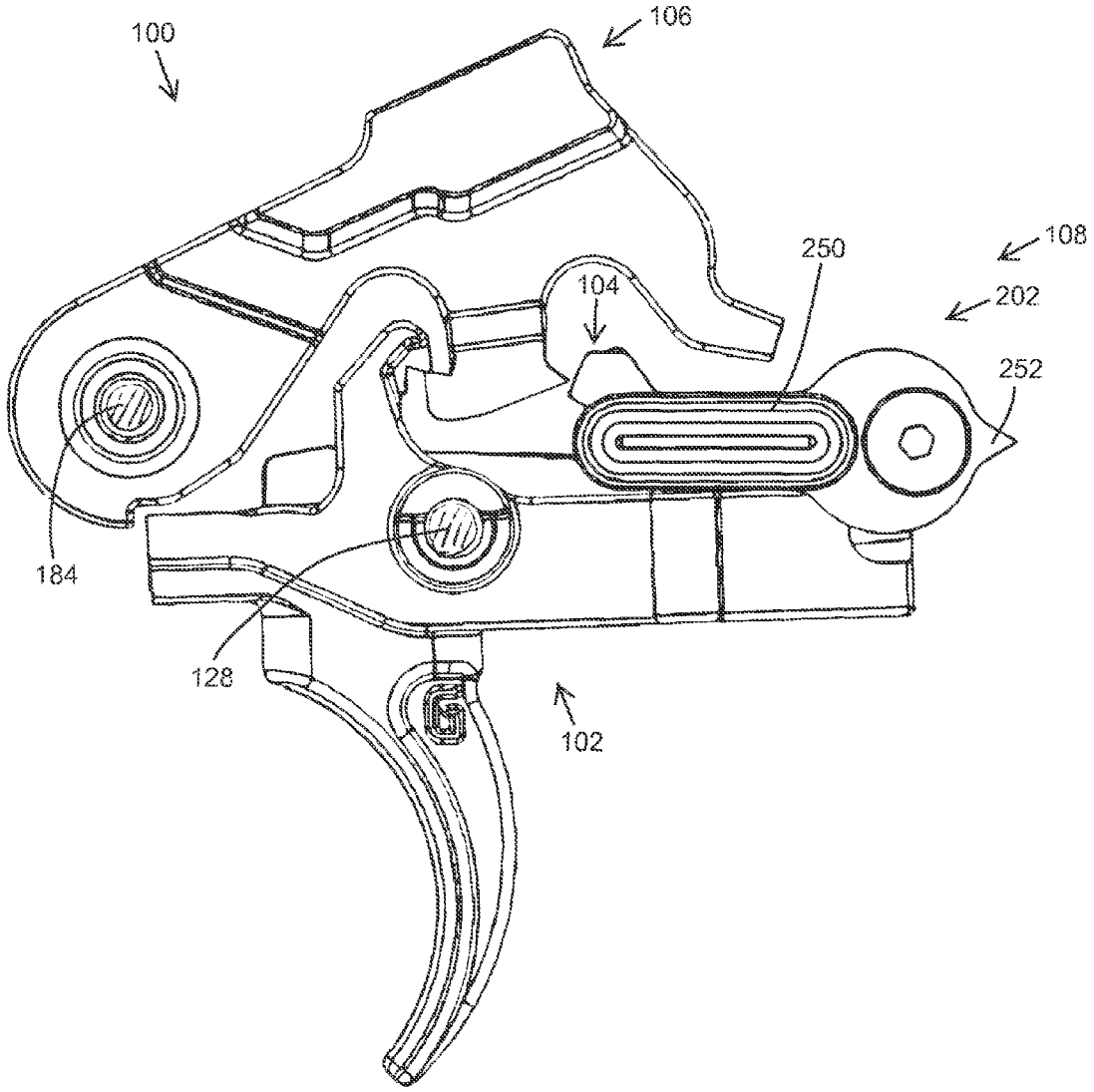
FIG. 16 is a schematic front view of the trigger mechanism in a second trigger mode.

The first stopper portion 232 is configured to engage the first disconnector leg 162 to disable the movement of the first disconnector 150 when the mode selector element 108 is in the third position 215 (FIG. 16). The first stopper portion 232 can be aligned with the first disconnector leg 162 of the first disconnector 150. As illustrated in FIGS. 5 and 6, the first stopper portion 232 is substantially flush with the outer surface of the cylindrical body 220.

Figure 11:
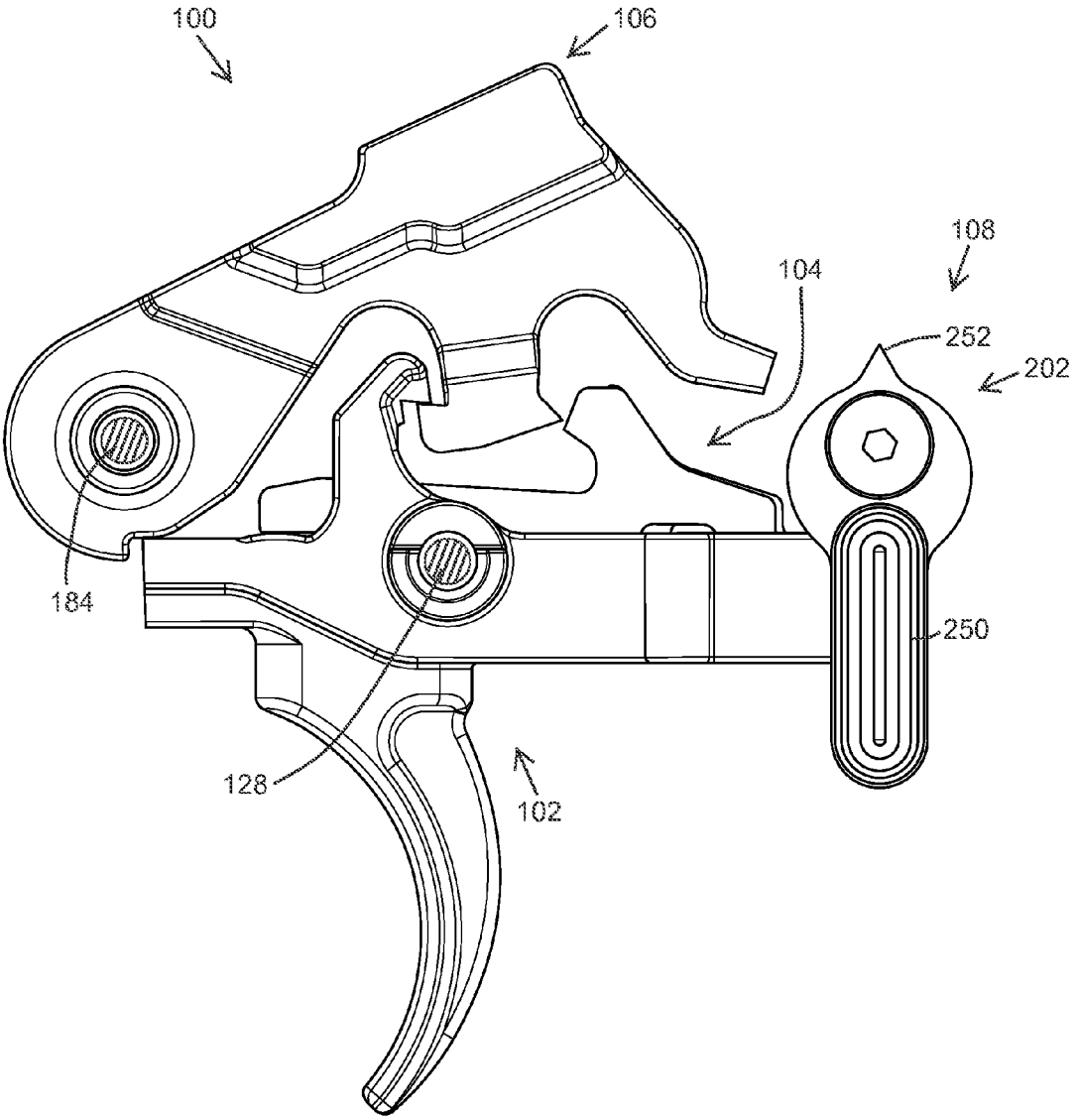
FIG. 11 is a schematic front view of the trigger mechanism in a first trigger mode.

The first slot portion 234 is configured to release the first disconnector leg 163 to enable the movement of the first disconnector 150 when the mode selector element 108 is in the second position 213 (FIG. 11). The first slot portion 234 can be aligned with the first disconnector leg 162 of the first disconnector 150. As the first disconnector leg 162 is allowed to freely move within the first slot portion 234, the first disconnector 150 can pivot as intended. In at least one embodiment, the first slot portion 234 is circumferentially apart from the first stopper portion 232. For example, the first slot portion 234 is positioned in about 90 degree displacement circumferentially from the first stopper portion 232.

The second stopper portion 236 is configured to engage the second disconnector leg 163 to disable the movement of the second disconnector 152 when the mode selector element 108 is in the second position 213 (FIG. 11). The second stopper portion 236 can be aligned with the second disconnector leg 163 of the second disconnector 152. As illustrated in FIGS. 5 and 6, the second stopper portion 236 is substantially flush with the outer surface of the cylindrical body 220. In at least one embodiment, the second stopper portion 236 is arranged adjacent the first slot portion 234 along the axis of rotation A.

The second slot portion 238 is configured to release the second disconnector leg 163 to enable the movement of the second disconnector 152 when the mode selector element 108 is in the third position 215 (FIG. 16). The second slot portion 238 can be aligned with the second disconnector leg 163 of the second disconnector 152. As the second disconnector leg 163 is allowed to freely move within the second slot portion 238, the second disconnector 152 can pivot as intended. In at least one embodiment, the second slot portion 238 is circumferentially apart from the second stopper portion 236. For example, the second slot portion 238 is positioned in about 90 degree displacement circumferentially from the second stopper portion 236. The second slot portion 238 is also arranged adjacent the first stopper portion 232 along the axis of rotation A.

The guide slot 240 operates to align the selector block 200 with the trigger element 102 and/or the disconnector assembly 104. In at least one embodiment, the guide slot 240 is configured to slidably receive a portion of the trigger body 112 as the mode selector element 108 rotates relative to the lower receiver 56 of the firearm 50. In the illustrated example, the guide slot 240 is arranged to receive the second lateral wall 117 of the trigger body 112 at or around the rearward trigger end 134. The guide slot 240 cooperates with the trigger body 112 to align the selector block 200 with the disconnector assembly 104 (e.g., the first and second dissconnectors 150 and 152, and more specifically the first and second disconnector legs 162 and 163).

With continued reference to FIGS. 5-9, the selector lever 202 includes a handle portion 250 and a mode indicator 252.

The handle portion 250 is configured to radially extend from the axis of rotation A and provides a grip to allow a user to rotate the selector block 200 between the first, second and third positions 211, 213 and 215. In the illustrated example, the handle portion 250 is aligned with the first slot portion 234 and the second stopper portion 236.

The mode indicator 252 is used to indicate one or more marks 80, 82 and 84 (FIG. 1) that represent different trigger modes (e.g., the safe mode 210, the first trigger mode 212, and the second trigger mode 214). The marks 80, 82 and 84 are provided on an outer surface of the lower receiver 56 of the firearm 50. For example, a first mark 80 can read "SAFE," a second mark 82 can read "TWO-STAGE," and a third mark 84 can read "SINGLE-STAGE." In at least one embodiment, the mode indicator 252 is arranged opposite to the handle portion 250.

Referring now to FIGS. 10-21, an example operation of the trigger mechanism 100 is illustrated and described in more detail. For clarity purposes, some of the components, such as the disconnector springs 164 and 165, the trigger element spring, the hammer element spring 189, are not illustrated.

FIG. 10 schematically illustrates an example operation of the trigger mechanism 100 in the safe mode 210. In the safe mode 210, the mode selector element 108 is in the first position 211 at which the handle portion 250 of the selector lever 202 extends rearward (to the right from the view of FIG. 10) and the mode indicator 252 is directed forward (to the left from the view of FIG. 10). In other embodiments, other orientations of the mode selector element 108 (e.g., the handle portion 250 and/or the mode indicator 252) are possible. The selector block 200 is arranged such that the common stopper portion 230 is abutted with the first and second disconnector legs 162 and 163 to prevent both of the first and second disconnectors 150 and 152 from pivoting around the trigger pin 128. Accordingly, the hammer element 106 is locked in the cocked position as illustrated in FIG. 10, and the trigger element 102 cannot be pulled enough to actuate the trigger mechanism 100.

Referring to FIGS. 11-15, an example operation of the trigger mechanism 100 in the first trigger mode 212 is illustrated and described in more detail. In at least one embodiment, the first trigger mode 212 is a two-stage trigger mode. In this mode, the first disconnector 150 (i.e., a two-stage disconnector) is enabled and the second disconnector 152 (i.e., a single-stage disconnector) is disabled.

Figure 12:
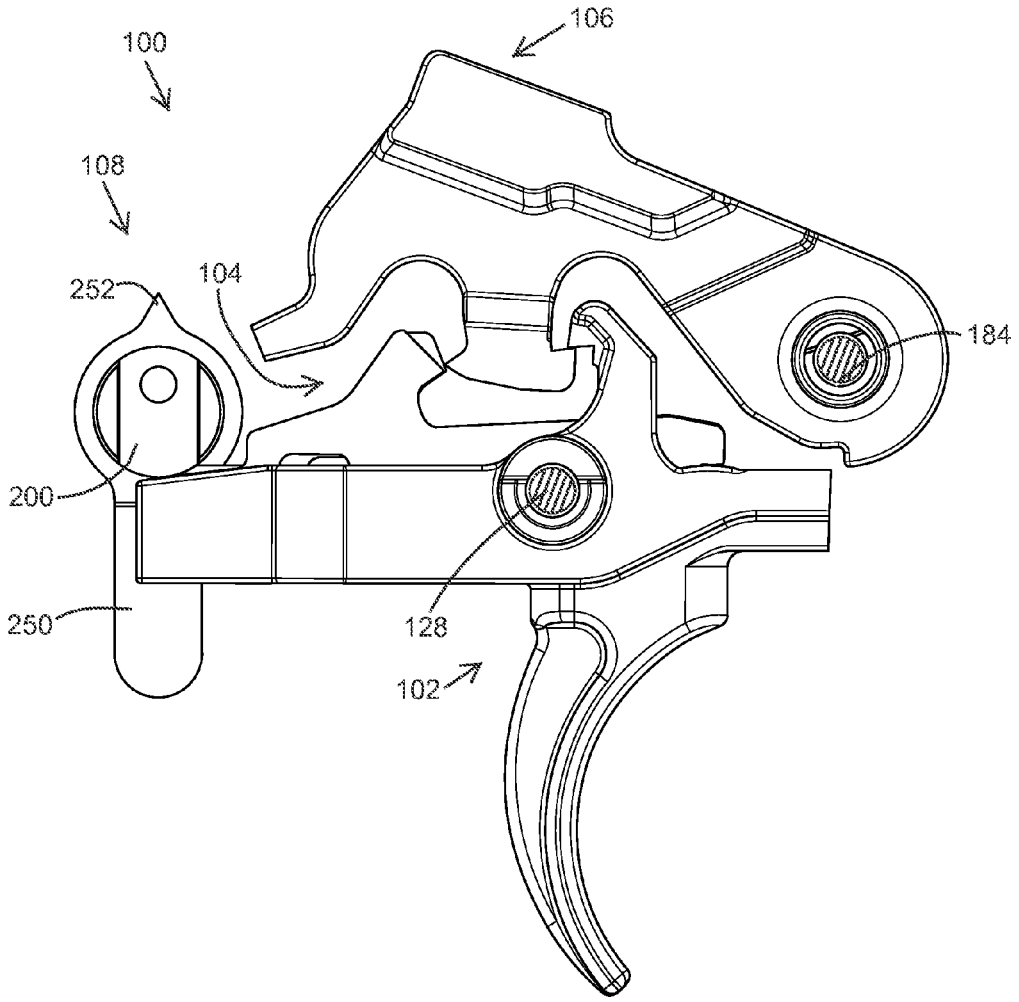
FIG. 12 is a schematic rear view of the trigger mechanism of FIG. 11.

FIGS. 11 and 12 illustrate an example position of the selector lever 202. In particular, FIG. 11 is a schematic front view of the trigger mechanism 100 in the first trigger mode 212, and FIG. 12 is a schematic rear view of the trigger mechanism 100 of FIG. 11. As illustrated in FIGS. 11 and 12, in the first trigger mode 212, the mode selector element 108 is in the second position 213 at which the handle portion 250 of the selector lever 202 extends downwards, and the mode indicator 252 is directed upwards. In other embodiments, other orientations of the mode selector element 108 (e.g., the handle portion 250 and/or the mode indicator 252) are possible.

Figure 13:
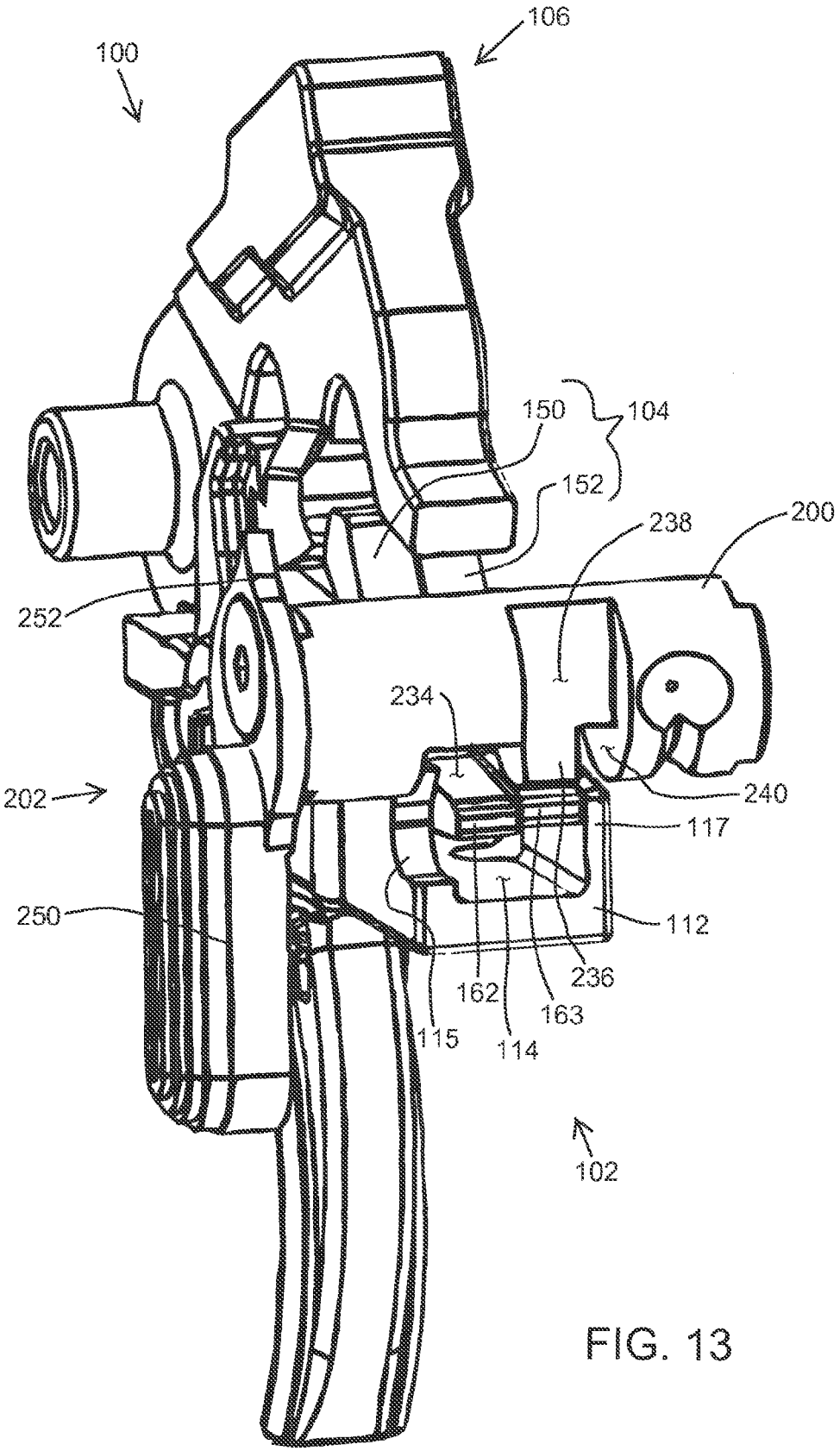
FIG. 13 is a perspective view of the trigger mechanism in a first trigger mode.
Figure 14:
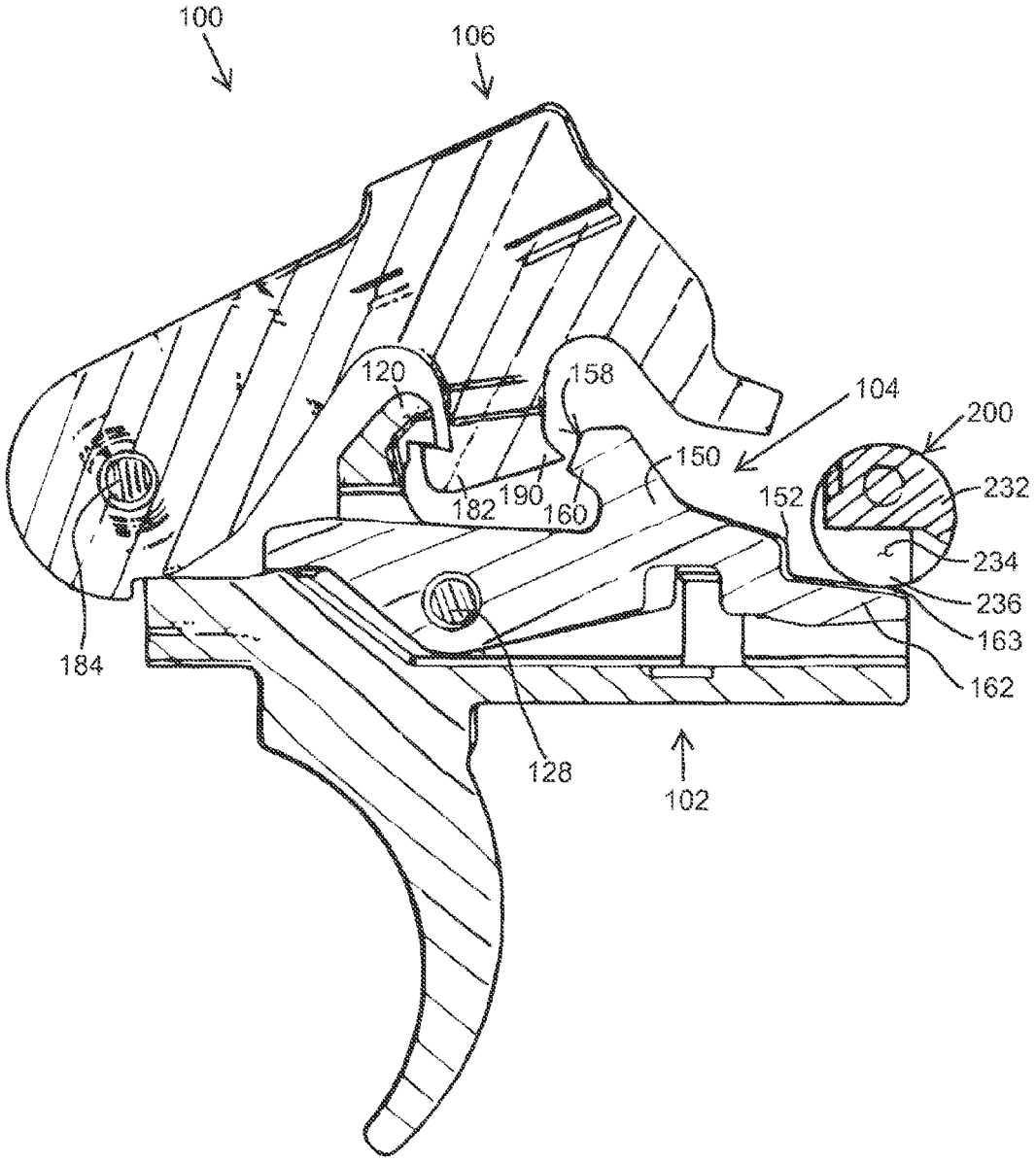
FIG. 14 is a cross-sectional side view of the trigger mechanism, taken along a first disconnector.
Figure 15:
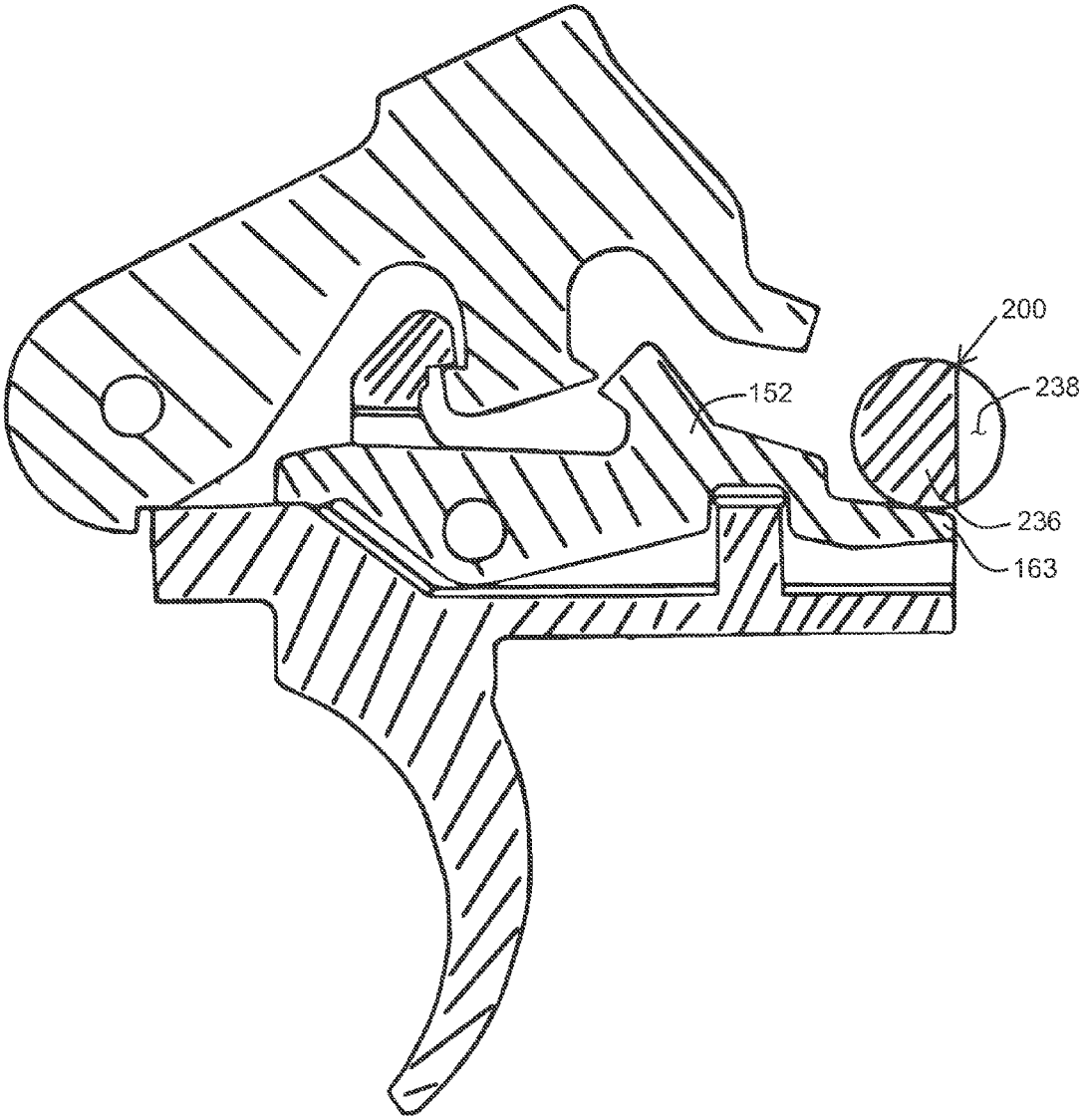
FIG. 15 is a cross-sectional side view of the trigger mechanism, taken along a second disconnector.

FIGS. 13-15 illustrate an example arrangement of the selector block 200 relative to the first and second disconnectors 150 and 152 in the first trigger mode 212. In particular, FIG. 13 is a perspective view of the trigger mechanism 100 in the first trigger mode 212, FIG. 14 is a cross-sectional side view of the trigger mechanism 100, taken along the first disconnector 150, and FIG. 15 is a cross-sectional side view of the trigger mechanism 100, taken along the second disconnector 152. When the mode selector element 108 is in the second position 213, as illustrated in FIGS. 13 and 14, the first slot portion 234 of the selector block 200 is arranged above the first disconnector leg 162 so that the first disconnector leg 162 moves up and down within the first slot portion 234 as the first disconnector 150 pivots about the trigger pin 128 as intended. Further, as illustrated in FIGS. 13 and 15, the second stopper portion 236 is arranged to contact the second disconnector leg 163 so that the second disconnector leg 163 is prohibited from moving upwards. Thus, the second disconnector 152 is blocked from pivoting about the trigger pin 128.

As discussed above, one example of the first trigger mode 212 is a two-stage trigger mode, and the first disconnector 150 is configured as a two-stage disconnector. As the trigger element 102 is pulled through the trigger lever 116, the trigger element 102 and the first disconnector 150 rotate about the trigger pin 128, and the trigger sear 120 is pulled off the hammer sear 182 until the contact surface 158 of the first disconnector 150 contacts the hammer tongue 190 of the hammer element 106. When the contact surface 158 of the first disconnector 150 contacts the hammer tongue 190 of the hammer element 106, the trigger sear 120 is minimally engaged with the hammer sear 182. At this point, the first stage pull is complete. The second stage of the trigger pull is a stage where the trigger lever 116 is further pulled to disengage the trigger sear 120 and the hammer sear 182. At the instant, the second stage pull is complete, and while the trigger lever 116 is still held in the pulled position, the recoil position of the hammer element 106 causes the hammer tongue 190 to force the disconnector catch 160 downward to compress the first disconnector spring 164 and to trap the hammer element 106 in the hammer tongue 190. Release of the trigger lever 116 causes the trigger element spring (e.g., a torsion spring) to return the trigger element 102 to the initial or reset position. As the trigger element 102 moves toward the reset position, the first disconnector 150 begins to release the hammer tongue 190 from the engagement with the disconnector catch 160, and the hammer sear 182 fully engages the trigger sear 120 with total separation of the hammer tongue 190 and the disconnector catch 160 to complete the firing and reset cycle.

Referring to FIGS. 16-20, an example operation of the trigger mechanism 100 in the second trigger mode 214 is illustrated and described in more detail. In at least one embodiment, the second trigger mode 214 is a single-stage trigger mode. In this mode, the second disconnector 152 (i.e., a single-stage disconnector) is enabled and the first disconnector 150 (i.e., a two-stage disconnector) is disabled.

Figure 17:
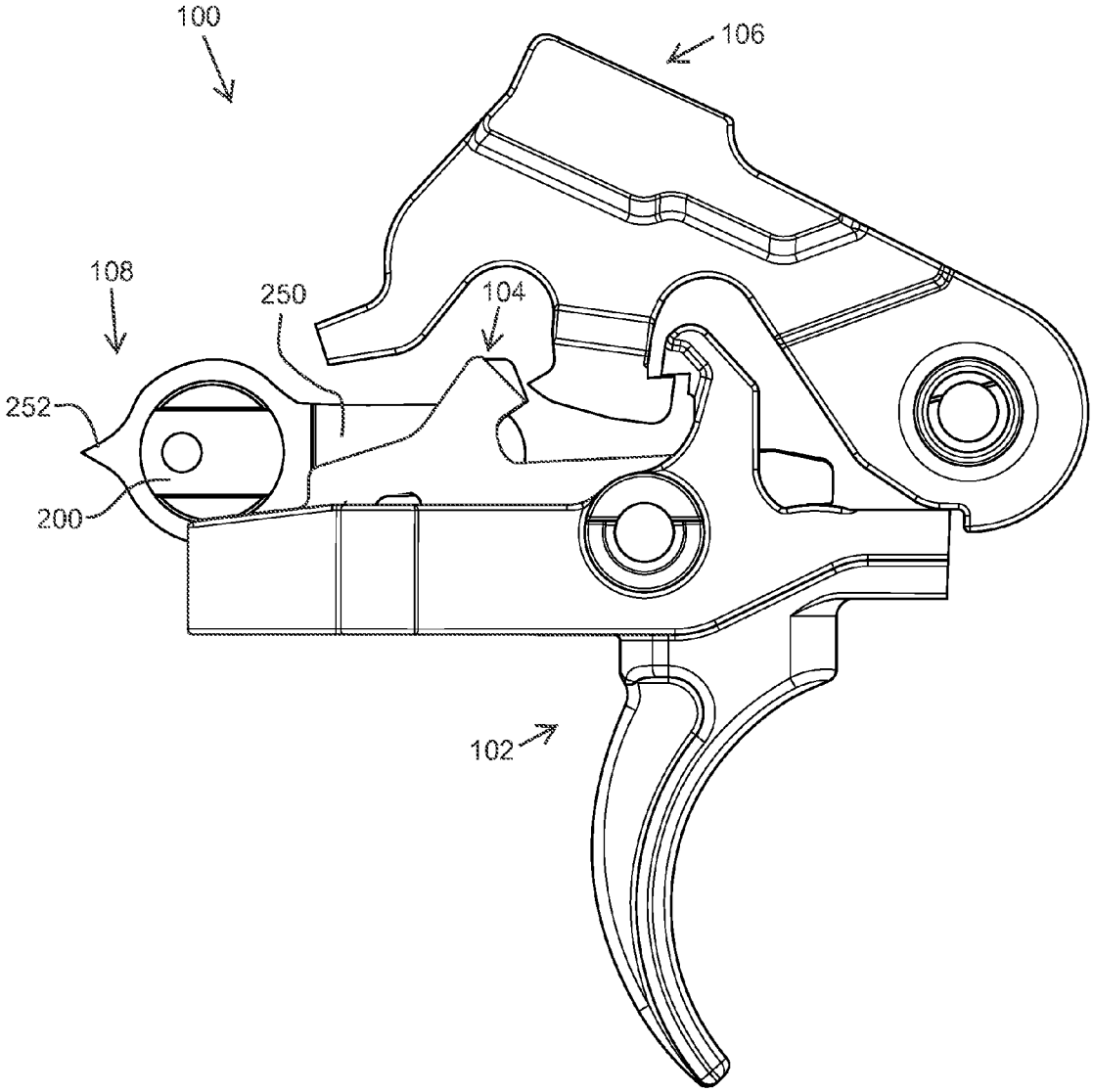
FIG. 17 is a schematic rear view of the trigger mechanism of FIG. 16.

FIGS. 16 and 17 illustrate an example position of the selector lever 202. In particular, FIG. 16 is a schematic front view of the trigger mechanism 100 in the second trigger mode 214, and FIG. 17 is a schematic rear view of the trigger mechanism 100 of FIG. 16. As illustrated in FIGS. 16 and 17, in the second trigger mode 214, the mode selector element 108 is in the third position 215 at which the handle portion 250 of the selector lever 202 extends forwards (to the left from the view of FIGS. 16 and 17), and the mode indicator 252 is directed rearwards (to the right from the view of FIGS. 16 and 17). In other embodiments, other orientations of the mode selector element 108 (e.g., the handle portion 250 and/or the mode indicator 252) are possible.

Figure 18:
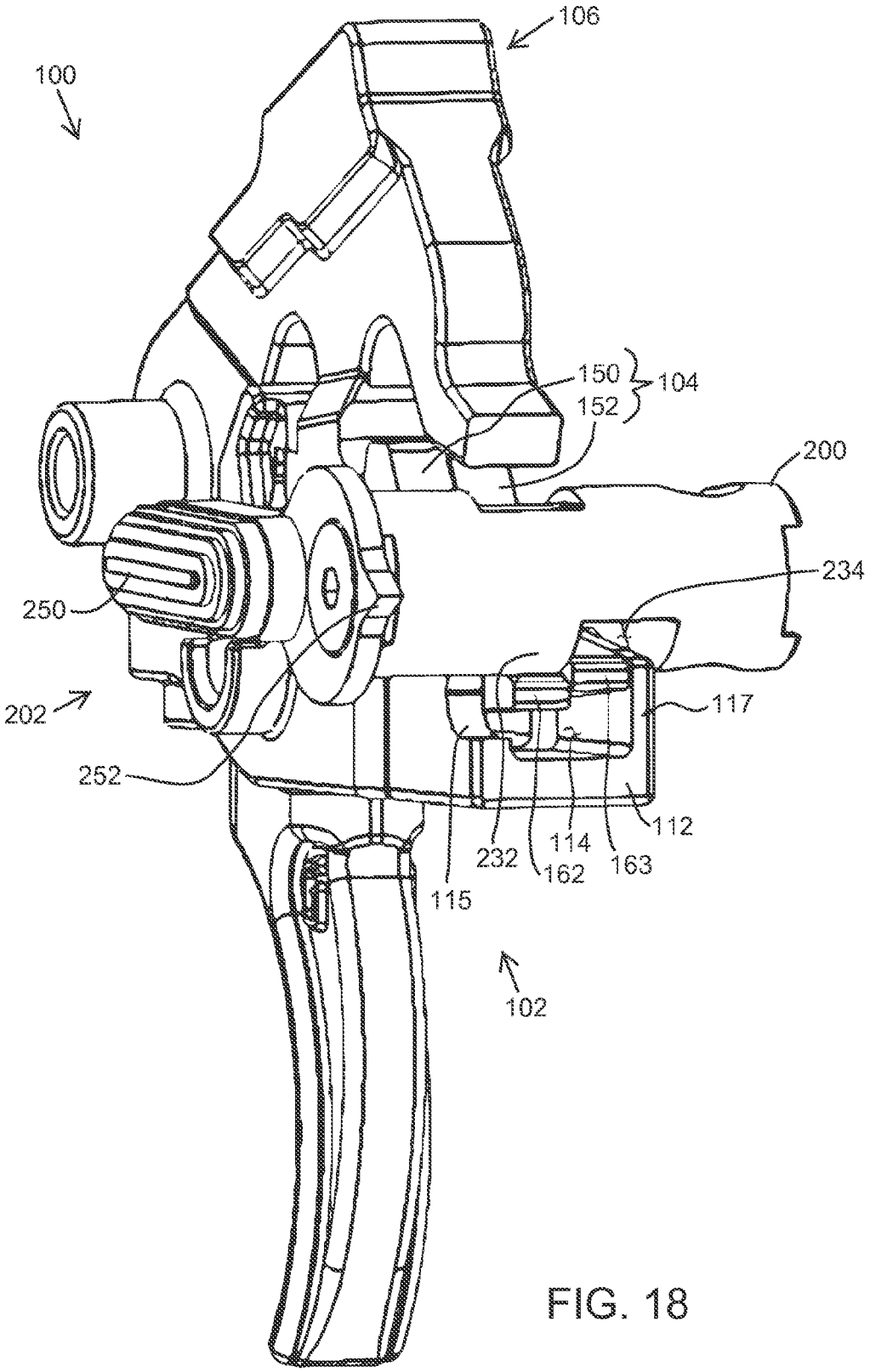
FIG. 18 is a perspective view of the trigger mechanism in the second trigger mode.
Figure 19:
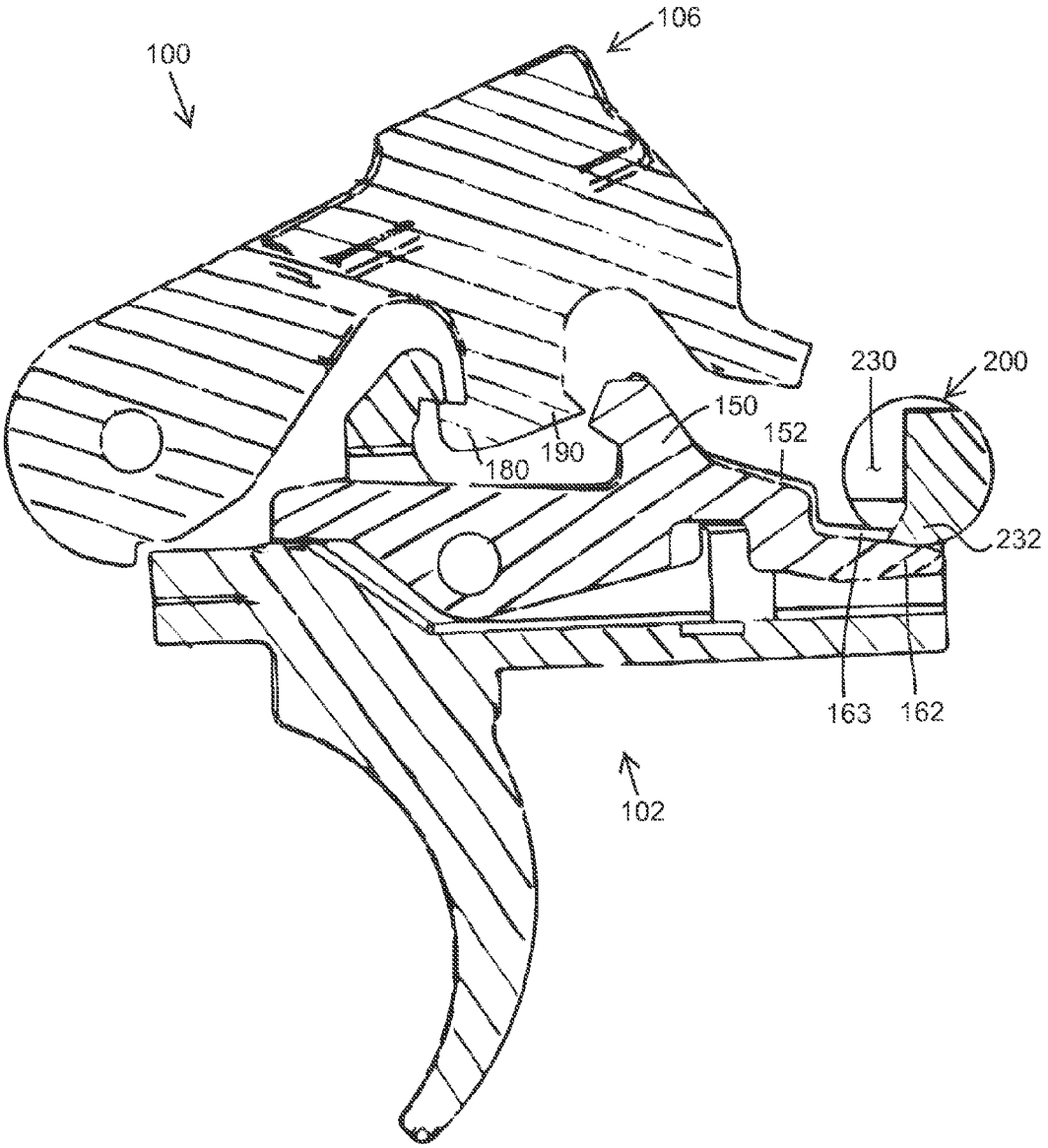
FIG. 19 is a cross-sectional side view of the trigger mechanism, taken along the first disconnector.
Figure 20:
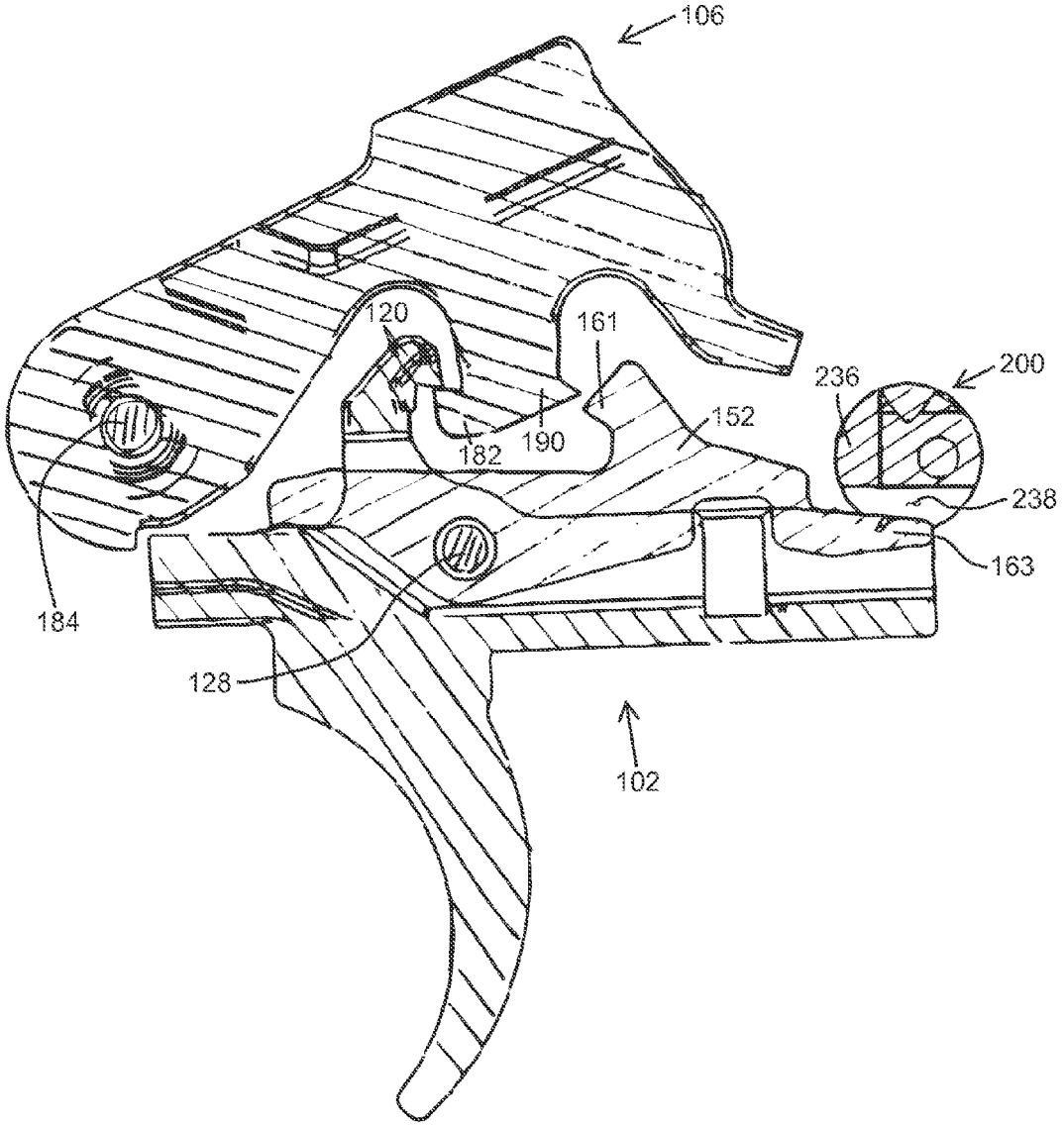
FIG. 20 is a cross-sectional side view of the trigger mechanism, taken along the second disconnector.

FIGS. 18-20 illustrate an example arrangement of the selector block 200 relative to the first and second disconnectors 150 and 152 in the second trigger mode 214. In particular, FIG. 18 is a perspective view of the trigger mechanism 100 in the second trigger mode 214, FIG. 19 is a cross-sectional side view of the trigger mechanism 100, taken along the first disconnector 150, and FIG. 20 is a cross-sectional side view of the trigger mechanism 100, taken along the second disconnector 152. When the mode selector element 108 is in the third position 215, as illustrated in FIGS. 18 and 19, the first stopper portion 232 of the selector block 200 is arranged to contact the first disconnector leg 162 so that the first disconnector leg 162 is prohibited from moving upwards. Thus, the first disconnector 150 is blocked from pivoting about the trigger pin 128. At the same time, as illustrated in FIGS. 18 and 20, the second slot portion 238 of the selector block 200 is arranged above the second disconnector leg 163 so that the second disconnector leg 163 moves up and down within the second slot portion 238 as the second disconnector 152 pivots about the trigger pin 128 as intended.

As discussed above, one example of the second trigger mode 214 is a single-stage trigger mode, and the second disconnector 152 is configured as a single-stage disconnector. In a single-stage trigger mode, as the trigger element 102 is pulled through the trigger lever 116, the trigger sear 120 disengages the hammer sear 182 to release the hammer element 106 from the cocked position to the released position. While the trigger lever 116 is still held in the pulled position, the recoil position of the hammer element 106 causes the hammer tongue 190 to force the second disconnect catch 161 downward to compress the second disconnector spring 165 and to trap the hammer element 106 in the hammer tongue 190. Release of the trigger lever 116 causes the trigger element spring (e.g., a torsion spring) to return the trigger element 102 to the initial or reset position. As the trigger element 102 moves toward the reset position, the second disconnector 152 begins to release the hammer tongue 190 from the engagement with the second disconnector catch 161, and the hammer sear 182 fully engages the trigger sear 120 with total separation of the hammer tongue 190 and the second disconnector catch 161 to complete the firing and reset cycle.

Figure 21:
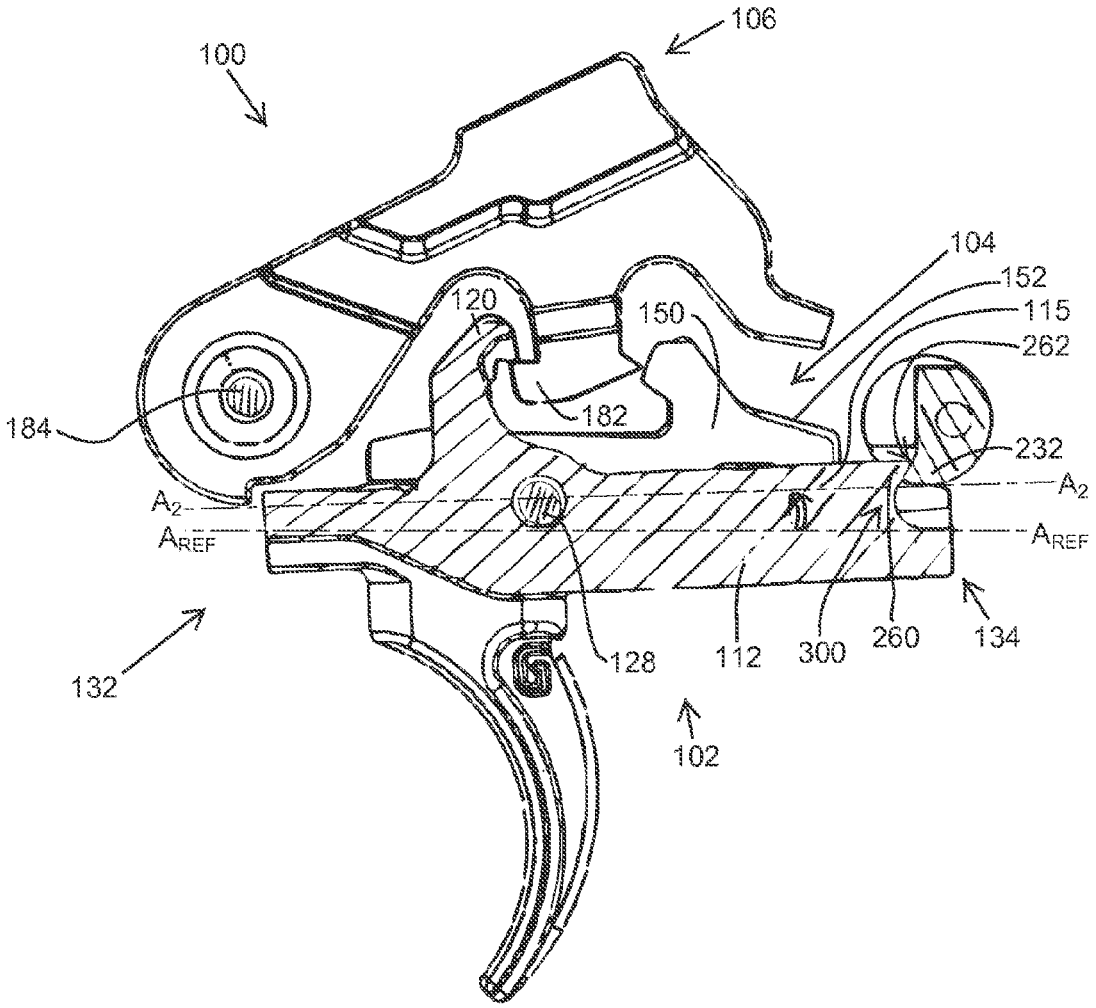
FIG. 21 is a cross-sectional view of the trigger mechanism in the second trigger mode, taken along a first lateral wall of a trigger body, illustrating a quick trigger mechanism.

FIG. 21 is a cross-sectional view of the trigger mechanism 100 in the second trigger mode 214, taken along the first lateral wall 115 of the trigger body 112, illustrating a quick trigger mechanism 300.

The quick trigger mechanism 300 operates to shorten a trigger pull before the trigger sear 120 disengages the hammer sear 182, thereby allowing a quicker operation of the trigger mechanism 100. In at least one embodiment, the quick trigger mechanism 300 is implemented in the single-stage trigger mode.

The quick trigger mechanism 300 is operated by a cooperation of the trigger element 102 and the mode selector element 108. In at least one embodiment, the quick trigger mechanism 300 includes a trigger body tail 260 formed in the trigger element 102 and a trigger body catch 262 formed in the selector block 200.

In at least one embodiment, the trigger body tail 260 is formed at or around the rearward trigger end 134 of the trigger body 112 of the trigger element 102. For example, the trigger body tail 260 is defined in the first lateral wall 115 of the trigger body 112 at the rearward trigger end 134.

The trigger body catch 262 (see also FIGS. 5 and 6) is configured to engage a portion of the trigger element 102 and lift up the trigger element 102 such that the trigger sear 120 slides off of the hammer sear 182 while maintaining an engagement between the trigger sear 120 and the hammer sear 182. In at least one embodiment, the trigger body catch 262 operates to engage the trigger body tail 260 of the trigger element 102 and lift up the trigger element 102 at the rearward trigger end 134. In at least one embodiment, the trigger body catch 262 is formed adjacent the first stopper portion 232 of the selector block 200 such that, in the second trigger mode 214 (e.g., the single-stage trigger mode), the first stopper portion 232 is positioned to abut the first disconnector leg 162 and the trigger body catch 262 engages the trigger body tail 260. In the second trigger mode 214, the trigger body catch 262 lifts up the trigger element 102 at the rearward trigger end 134. As illustrated in FIG. 21, a longitudinal axis A2 of the trigger body 112 is tilted counterclockwise about the trigger pin 128 from a reference axis $A_{REF}$, which, for example, represents a longitudinal orientation of the lower receiver 56 of the firearm 50. As the trigger element 102 is angled, the trigger sear 120 slides at least some of the way off of the hammer sear 182 such that an overall travel of the trigger element 102 around the trigger pin 128 is shortened, thereby allowing a quicker trigger pull.

Figure 22:
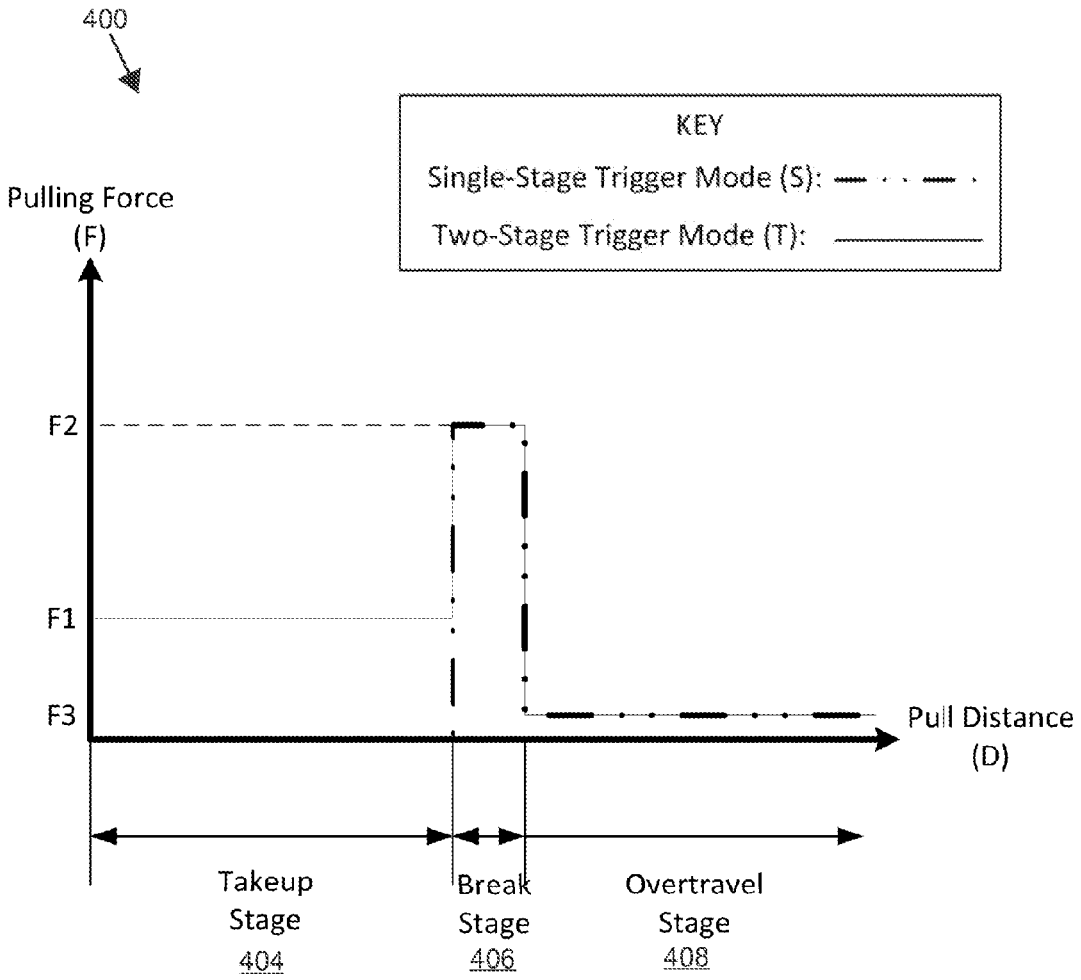
FIG. 22 illustrates an example combination of trigger modes having different pull characteristics.

FIG. 22 illustrates an example combination of trigger modes having different pull characteristics. A graph 400 depicts a relationship between a pull distance (D) and a pulling force (F). The pull distance (D) indicates an amount of movement of the trigger element 102 (e.g., the trigger lever 116) as it is pulled back. The pulling force (F) indicates a force required to pull the trigger element 102 (e.g., the trigger lever 116). The pulling force (F) is also referred to herein as a pull weight.

In this example, the disconnector assembly 104 includes two disconnectors 150 and 152, which include a single-stage trigger disconnector and a two-stage trigger disconnector. The single-stage trigger disconnector provides a single-stage trigger mode (S), and the two-state trigger disconnector provides a two-stage trigger mode (T).

As described above, the pull characteristics of the single-stage and two-stage trigger modes (S, T) are described by a takeup stage 404, a break stage 406, and an overtravel stage 408.

When the two-stage trigger mode (T) is selected, a first amount (F1) of pulling force is required during the takeup stage 404 until a contact surface (e.g., the contact surface 158) of the single-stage trigger disconnector contacts the hammer tongue 190 of the hammer element 106. At the break stage 406, the trigger lever 116 is further pulled with a second amount (F2) of pulling force to disengage the trigger sear 120 and the hammer sear 182. After the break stage 406 (i.e., during the overtravel stage 408), the trigger lever 116 is still held in the pulled position with a third amount (F3) of pulling force until a recoiling operation is complete. In some embodiments, the second amount (F2) of pulling force is greater than the first amount (F1) of pulling force, which is greater than the third amount (F3) of pulling force. The third amount (F3) of pulling force can be determined by the spring supporting the trigger element 102.

When the single-stage trigger mode (S) is selected, the trigger lever 116 moves little or does not move at all until the break stage 406. At the break stage 406, the trigger lever 116 is pulled with the second amount (F2) of pulling force to disengage the trigger sear 120 and the hammer sear 182. After the break stage 406 (i.e., during the overtravel stage 408), the trigger lever 116 is still held in the pulled position with the third amount (F3) of pulling force until a recoiling operation is complete. In some embodiments, the second amount (F2) of pulling force in the single-stage trigger mode (S) is configured to be different from the second amount (F2) of pulling force in the two-stage trigger mode (T)

Figure 23:
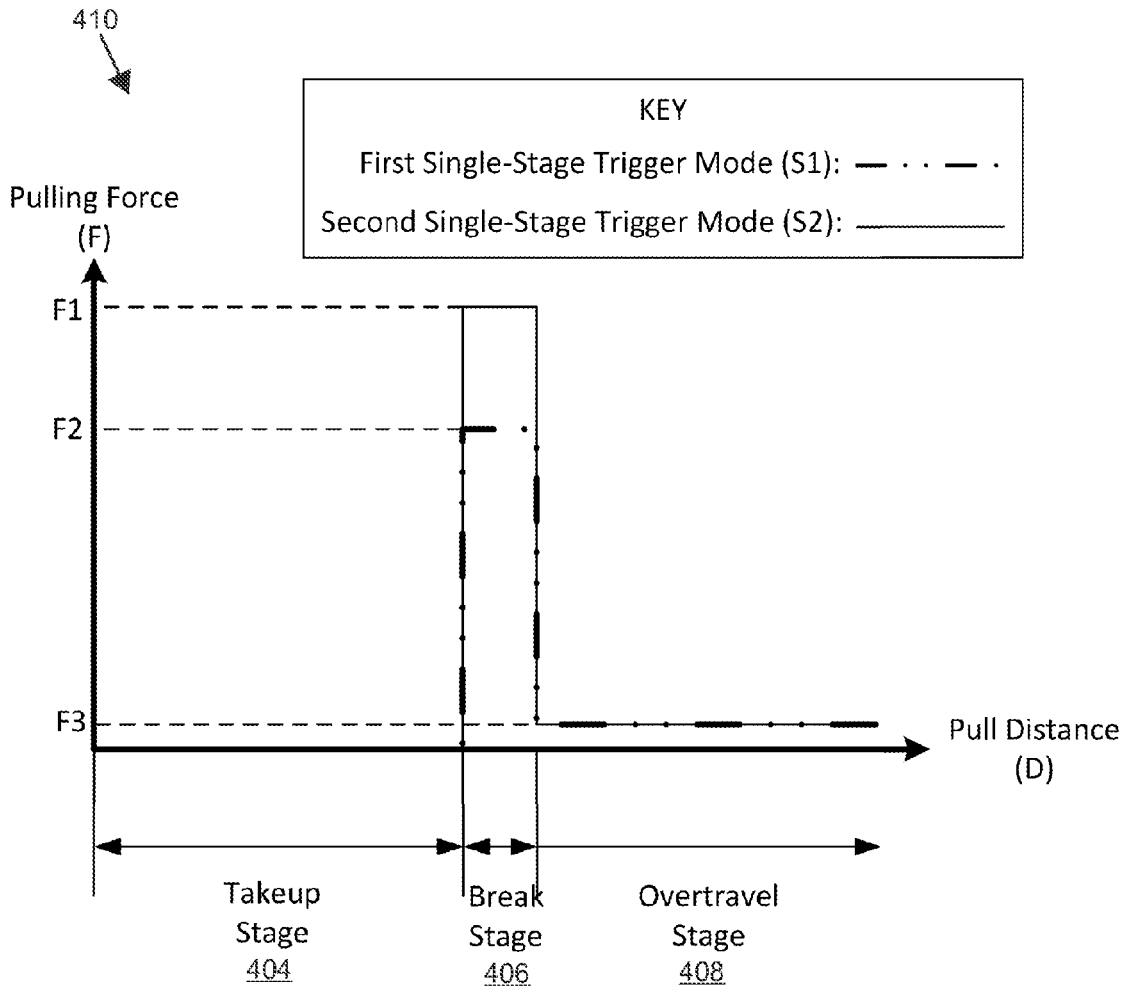
FIG. 23 illustrates another example combination of trigger modes having different pull characteristics.

FIG. 23 is a graph 410 illustrating another example combination of trigger modes having different pull characteristics.

In this example, the disconnector assembly 104 includes two disconnectors 150 and 152, which include two single-stage trigger disconnectors having different pull characteristics. For example, the two disconnectors 150 and 152 provide a first single-stage trigger mode (S1) and a second single-stage trigger mode (S2), each of which is described by the takeup stage 404, the break stage 406, and the overtravel stage 408.

The two single-stage trigger disconnectors in this example are operated similarly to the single-stage trigger disconnector as illustrated in FIG. 22. In this example, however, the first single-stage trigger mode (S1) has a pull characteristic different from that of the second single-stage trigger mode (S2). For example, a pulling force (F1) required at the break stage 406 in the first single-stage trigger mode (S1) is different from a pulling force (F2) required at the break stage 406 in the second single-stage trigger mode (S2).

Figure 24:
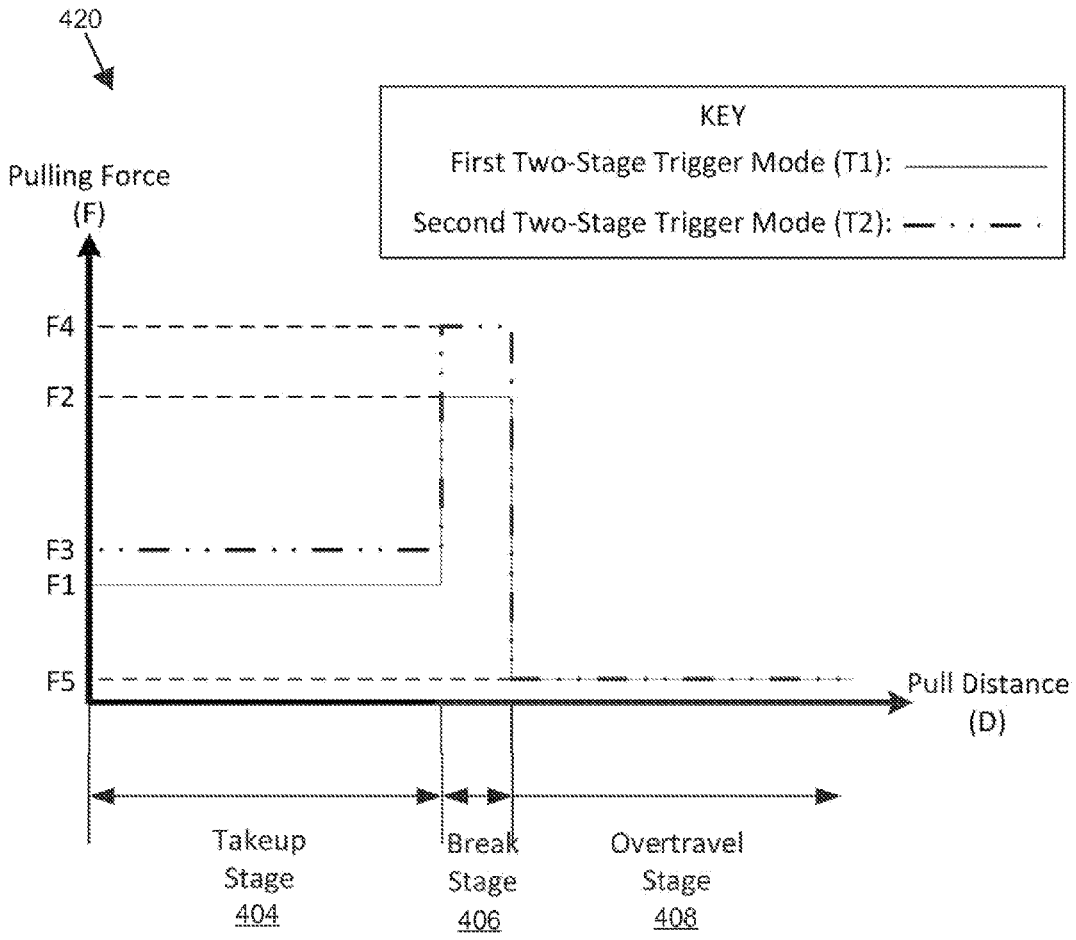
FIG. 24 illustrates yet another example combination of trigger modes having different pull characteristics.

FIG. 24 is a graph 420 illustrating yet another example combination of trigger modes having different pull characteristics.

In this example, the disconnector assembly 104 includes two disconnectors 150 and 152, which include two two-stage trigger disconnectors having different pull characteristics. For example, the two disconnectors 150 and 152 provide a first two-stage trigger mode (T1) and a second two-stage trigger mode (T2), each of which is described by the takeup stage 404, the break stage 406, and the overtravel stage 408.

The two two-stage trigger disconnectors in this example are operated similarly to the two-stage trigger disconnector as illustrated in FIG. 22. In this example, however, the first two-stage trigger mode (T1) has a pull characteristic different from that of the second two-stage trigger mode (T2). For example, a pulling force (F1) required at the takeup stage 404 in the first two-stage trigger mode (T1) is different from a pulling force (F3) required at the takeup stage 406 in the second two-stage trigger mode (T2). Further, a pulling force (F2) required at the break stage 406 in the first two-stage trigger mode (T1) is different from a pulling force (F4) required at the break stage 406 in the second two-stage trigger mode (T2).

Figure 25:
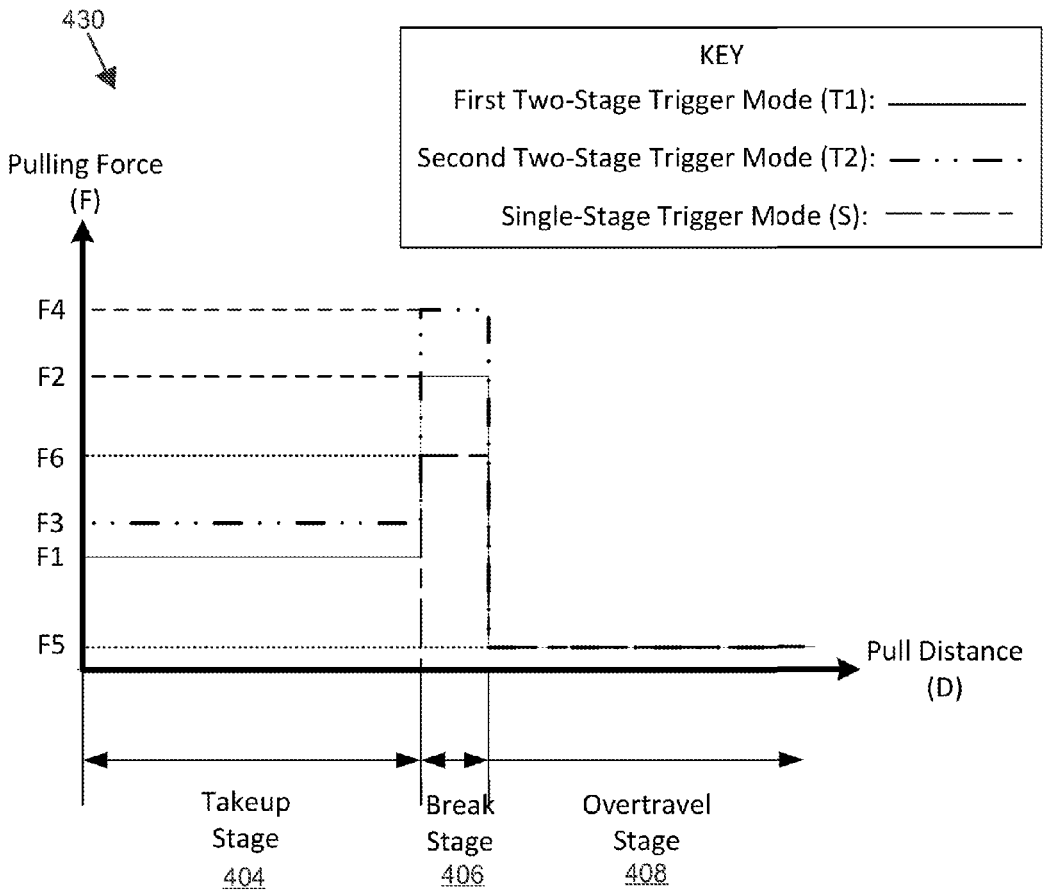
FIG. 25 illustrates yet another example combination of trigger modes having different pull characteristics.

FIG. 25 is a graph 430 illustrating yet another example combination of trigger modes having different pull characteristics.

In this example, the disconnector assembly 104 includes three disconnectors, which include two two-stage trigger disconnectors having different pull characteristics and one single-stage trigger disconnetor. For example, two of the three disconnectors provide a first two-stage trigger mode (T1) and a second two-stage trigger mode (T2), and the third disconnector provides a single-stage trigger mode (S). Each of the three different modes (T1, T2, and S) is described by the takeup stage 404, the break stage 406, and the overtravel stage 408.

The two two-stage trigger disconnectors in this example are configured similarly to the two-stage trigger disconnector as illustrated in FIG. 24 such that the first two-stage trigger mode (T1) has a pull characteristic different from that of the second two-stage trigger mode (T2). Further, the single-trigger disconnector in this example is configured similarly to the single-stage trigger disconnector as illustrated in FIG. 22. The details of the first and second two-stage trigger modes (T1, T2) and the single-stage trigger mode (S) are not repeated for brevity purposes.

As such, the disconnector assembly 104 can be configured to provide various combinations of two or more disconnectors to allow selecting between two or more of different pull characteristics. In addition to the applications illustrated in FIGS. 22-25, other variations are similarly possible. As the disconnector assembly 104 varies, the mode selector element 108 is accordingly modified to interact with the different disconnectors in a similar manner in accordance with the principles of the present disclosure.

In some of the embodiments described herein (such as embodiments described with reference to FIGS. 22-25 and other possible embodiments), the trigger mechanism 100 is configured to provide selectable pull weights for single or two-stage triggers. In some embodiments, the pull weight for a single stage trigger is in a range from about 1 lb. to about 5 lbs. In other examples, the pull weight for a single stage trigger is in a range from about 2 lbs. to about 4 lbs. Other embodiments can have pull weights outside of these ranges for a single stage trigger.

Regarding the pull weight for a two-stage trigger, the total pull weight for a two-stage trigger is in a range from about 2 lbs. to about 7 lbs. In other examples, the total pull weight for a two-stage trigger is in a range from about 3 lbs. to about 5 lbs. Further, some examples of the pull weight in the first stage are in a range from about 1 lb. to about 4 lbs., and some examples of the pull weight in the second stage are in a range from about 1 lb. to about 2 lbs. In other examples, the pull weight in the first stage is a range from about 2.3 lbs. to about 2.5 lbs., and the pull weight in the second stage is in a range from about 1.2 lbs. to about 2 lbs. In some embodiments, the pull weight in the second stage is configured to be less than the pull weight in the first stage. Other ranges of the pull weight in the first and second stages for a two-stage trigger are also possible.

The various examples described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. A trigger mechanism for a firearm comprising:

a hammer element operable between a cocked position and a released position, the hammer element including a hammer sear;

a trigger element including a trigger sear, the trigger element being moveable between a starting position and a pulled position, wherein when the trigger element is in the starting position the trigger sear is engaged with the hammer sear and holds the hammer element in the cocked position, and wherein when the trigger element is in the pulled position the hammer sear is released from the trigger sear;

a plurality of disconnector elements, each configured to interact with the trigger element to provide different pull characteristics, the pull characteristics including at least one of a takeup and a break; and a mode selector element adjustable between a plurality of positions to select between the plurality of disconnector elements and the different pull characteristics, wherein the trigger element includes a trigger body, and the trigger sear includes an extension portion and a hook portion, the extension portion extending from the trigger body, and the hook portion extending from the extension portion.

2. The trigger mechanism of claim 1, wherein the mode selector element is configured to selectively enable a movement of one of the plurality of disconnector elements and disable a movement of the remaining disconnector elements.

3. The trigger mechanism of claim 1, wherein the mode selector element is configured to disable a movement of the plurality of disconnector elements.

4. The trigger mechanism of claim 1, wherein:

the plurality of disconnector elements includes a first disconnector and a second disconnector, the first disconnector configured to provide a first trigger mode of the trigger mechanism having a first pull characteristic, and the second disconnector configured to provide a second trigger mode of the trigger mechanism having a second pull characteristic; and the mode selector element is adjustable to a first position such that the mode selector element is configured to disable a movement of the first and second disconnector in the first position.

5. The trigger mechanism of claim 4, wherein the mode selector element is further adjustable between a second position and a third position such that the mode selector element is configured to permit a movement of the first disconnector and disable a movement of the second disconnector in the second position and to permit a movement of the second disconnector and disable a movement of the first disconnector in the third position.

6. The trigger mechanism of claim 5, wherein:

the first disconnector is a two-stage trigger disconnector including a first disconnector catch and a contact surface, the first disconnector catch configured to catch a hammer tongue of the hammer element as the hammer element returns to the cocked position, and the contact surface configured to contact the hammer tongue of the hammer element while the trigger sear is engaged with the hammer sear, the hammer tongue arranged opposite to the hammer sear; and the second disconnector is a single-stage trigger disconnector including a second disconnector catch, the second disconnector catch configured to catch the hammer tongue of the hammer element as the hammer element returns to the cocked position.

7. The trigger mechanism of claim 6, wherein:

the first disconnector includes a first disconnector leg configured to selectively interact with the mode selector element;

the second disconnector includes a second disconnector leg configured to selectively interact with the mode selector element; and the mode selector element includes a selector block configured to rotate along an axis of rotation to selectively interact with at least one of the first and second disconnector legs such that, when the mode selector element is in the first position, the selector block engages the first and second disconnector legs to prevent a movement of the first and second disconnectors; when the mode selector element is in the second position, the selector block engages the second disconnector leg to prevent a movement of the second disconnector and disengages the first disconnector leg to enable a movement of the first disconnector; and when the mode selector element is in the third position, the selector block engages the first disconnector leg to prevent a movement of the first disconnector and disengages the second disconnector leg to enable a movement of the second disconnector.

8. The trigger mechanism of claim 7, wherein the selector block of the mode selector element comprises:

a common stopper portion configured to engage the first and second disconnector legs to disable the movement of the first and second disconnectors when the mode selector element is in the first position;

a first stopper portion configured to engage the first disconnector leg to disable the movement of the first disconnector when the mode selector is in the third position;

a first slot portion circumferentially apart from the first stopper and configured to release the first disconnector leg to enable the movement of the first disconnector when the mode selector is in the second position;

a second stopper portion arranged adjacent the first slot portion along the axis of rotation and configured to engage the second disconnector leg to disable the movement of the second disconnector when the mode selector is in the second position; and a second slot portion circumferentially apart from the second stopper portion and arranged adjacent the first stopper portion along the axis of rotation, the second slot portion configured to release the second disconnector leg to enable the movement of the second disconnector when the mode selector is in the third position.

9. The trigger mechanism of claim 7, wherein the mode selector element includes a selector lever for enabling a user to change a position of the selector block among the first, second, and third position.

10. The trigger mechanism of claim 9, wherein the selector lever includes a handle portion radially extending from the axis of rotation.

11. The trigger mechanism of claim 8, wherein the selector block of the mode selector element further comprises:

a guide slot configured to align the selector block with the disconnector element such that the first stopper portion and the first slot portion are aligned with the first disconnector leg and the second stopper portion and the second slot portion are aligned with the second disconnector leg.

12. The trigger mechanism of claim 11, wherein the guide slot is configured to slidably receive a portion of the trigger element as the mode selector element rotates about the axis of rotation.

13. The trigger mechanism of claim 1, further comprising a quick trigger mechanism comprising a trigger body catch formed in the selector block of the mode selector element and configured to engage a portion of the trigger element and lift up the trigger element while maintaining an engagement between the trigger sear and the hammer sear.

14. The trigger mechanism of claim 13, wherein the quick trigger mechanism further comprises:

a trigger body tail formed in the trigger element and configured to engage the trigger body catch of the selector block when the selector block is in a predetermined position.

15. The trigger mechanism of claim 14, wherein the quick trigger mechanism is implemented when the trigger mechanism is in a single-stage trigger operation.

16. A firearm for providing a plurality of trigger modes, the firearm comprising:

a receiver body; and a trigger mechanism received and supported in the receiver body, the trigger mechanism comprising:

a trigger element pivotally supported by the receiver body, the trigger element including a trigger sear;

a plurality of disconnector elements pivotally supported by the receiver body and configured to provide different pull characteristics, the pull characteristics including at least one of a takeup and a break;

a hammer element pivotally supported by the receiver body and operable between a cocked position and a released position, the hammer element including a hammer sear, the hammer sear configured to engage the trigger sear when the hammer element is in the cocked position; and a mode selector element adjustable between a plurality of positions to select between different trigger modes providing the different pull characteristics;

wherein the trigger element includes a trigger body, and the trigger sear includes an extension portion and a hook portion, the extension portion extending from the trigger body, and the hook portion extending from the extension portion.

17. The firearm of claim 16, wherein the mode selector element is configured to selectively enable a movement of one of the plurality of disconnector elements and disable a movement of the remaining disconnector elements.

18. The firearm of claim 16, wherein:

the plurality of disconnector elements includes a first disconnector and a second disconnector, the first disconnector configured to provide a first trigger mode of the trigger mechanism having a first pull characteristic, and the second disconnector configured to provide a second trigger mode of the trigger mechanism having a second pull characteristic; and the mode selector element operated between a first position, a second position, and a third position such that the mode selector element configured to disable a movement of the first and second disconnector in the first position, to permit a movement of the first disconnector and disable a movement of the second disconnector in the second position, and to permit a movement of the second disconnector and disable a movement of the first disconnector in the third position.

19. A trigger mechanism for a firearm comprising:

a trigger element including a trigger sear;

a plurality of disconnector elements, each configured to provide different pull characteristics, the pull characteristics including at least one of a takeup and a break;

a hammer element operable between a cocked position and a released position, the hammer element including a hammer sear configured to engage the trigger sear when the hammer element is in the cocked position; and a mode selector element adjustable between a plurality of positions to select between the different pull characteristics, wherein the trigger element includes a trigger body, and the trigger sear includes an extension portion and a hook portion, the extension portion extending from the trigger body, and the hook portion extending from the extension portion.

20. The trigger mechanism of claim 1, wherein:

the hammer element includes a hammer tongue arranged opposite to the hammer sear; and the plurality of disconnector elements include a first disconnector element comprising a first disconnector catch and a contact surface, wherein the first disconnector catch is configured to catch the hammer tongue of the hammer element as the hammer element returns to the cocked position, and the contact surface is configured to contact the hammer tongue of the hammer element while the trigger sear is engaged with the hammer sear.

21. A trigger mechanism for a firearm comprising:

a hammer element operable between a cocked position and a released position, the hammer element including a hammer sear;

a trigger element including a trigger sear, the trigger element being moveable between a starting position and a pulled position, wherein when the trigger element is in the starting position the trigger sear is engaged with the hammer sear and holds the hammer element in the cocked position, and wherein when the trigger element is in the pulled position the hammer sear is released from the trigger sear;

a plurality of disconnector elements, each configured to interact with the trigger element to provide different pull characteristics;

a mode selector element adjustable between a plurality of positions to select between the plurality of disconnector elements and the different pull characteristics; and a quick trigger mechanism including a trigger body catch formed in the selector block of the mode selector element and configured to engage a portion of the trigger element and lift up the trigger element while maintaining an engagement between the trigger sear and the hammer sear.

22. The trigger mechanism of claim 21, wherein the quick trigger mechanism further comprises a trigger body tail formed in the trigger element and configured to engage the trigger body catch of the selector block when the selector block is in a predetermined position.

23. The trigger mechanism of claim 22, wherein the quick trigger mechanism is implemented when the trigger mechanism is in a single-stage trigger operation.

* * * * *